US006639590B2

(12) United States Patent
Takahashi et al.

(10) Patent No.: US 6,639,590 B2
(45) **Date of Patent: *Oct. 28, 2003**

(54) METHOD FOR CONTROLLING LIQUID CRYSTAL DISPLAY DEVICE, DEVICE FOR DRIVING LIQUID CRYSTAL DISPLAY DEVICE, LIQUID CRYSTAL DISPLAY DEVICE, AND ELECTRONIC APPARATUS

(75) Inventors: Kotoyoshi Takahashi, Suwa (JP); Hisanori Kawakami, Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/292,939

(22) Filed: Apr. 16, 1999

(65) Prior Publication Data

US 2002/0196223 A1 Dec. 26, 2002

(30) Foreign Application Priority Data

Apr. 16, 1998 (JP) ..... 10-106786

(51) Int. Cl.[7] ..... G09G 5/00; G09G 3/18

(52) U.S. Cl. ..... 345/211; 345/204; 345/52; 345/214

(58) Field of Search ..... 345/204, 211, 345/212, 214, 215, 50, 52, 92, 91, 90, 87, 89, 93, 94, 95–104, 37

(56) References Cited

U.S. PATENT DOCUMENTS

| | | | | | |
|---|---|---|---|---|---|
| 3,653,745 | A | * | 4/1972 | Mao | 350/160 |
| 4,775,861 | A | * | 10/1988 | Saito | 340/784 |
| 5,248,963 | A | * | 9/1993 | Yasui et al. | 345/98 |
| 5,592,191 | A | * | 1/1997 | Tsuboyama et al. | 345/97 |
| 5,793,346 | A | * | 8/1998 | Moon | 345/92 |
| 5,828,429 | A | * | 10/1998 | Takemura | 349/42 |
| 6,005,541 | A | * | 12/1999 | Takahashi et al. | 345/211 |
| 6,151,016 | A | * | 11/2000 | Kanbe et al. | 345/204 |
| 6,262,704 | B1 | * | 7/2001 | Kurumisawa et al. | 345/98 |

* cited by examiner

*Primary Examiner*—Steven Saras
*Assistant Examiner*—Alecia Nelson
(74) *Attorney, Agent, or Firm*—Oliff & Berridge, PLC

(57) ABSTRACT

The present invention permits quick removal of charge stored in a liquid crystal layer, without depending upon characteristics of individual devices. This is achieved by providing a detector that detects the turning-off of a power supply, and a connection device that, upon detection of the turning-off of the power supply by the detector, connects to a predetermined line either or both of scanning lines to which scanning signals are supplied and data lines to which data signals are supplied, and connecting the predetermined line to a constant potential.

19 Claims, 21 Drawing Sheets

| D2 | D1 | D0 | OUTPUT |
|---|---|---|---|
| 0 | 0 | 0 | V4 |
| 0 | 0 | 1 | V2 |
| 0 | 1 | 0 | V0 |
| 0 | 1 | 1 | V6 |
| 1 | 0 | 0 | V3 |
| 1 | 0 | 1 | V5 |
| 1 | 1 | 0 | V7 |
| 1 | 1 | 1 | V1 |

METHOD FOR CONTROLLING LIQUID CRYSTAL DISPLAY DEVICE, DEVICE FOR DRIVING LIQUID CRYSTAL DISPLAY DEVICE, LIQUID CRYSTAL DISPLAY DEVICE, AND ELECTRONIC APPARATUS

BACKGROUND OF THE INVENTION

1. Field of the Invention

The present invention relates to a method for controlling a liquid crystal display device which prevents deterioration of the liquid crystal by quickly removing the charge stored in each liquid crystal layer after, for example, turning off of the power supply, a device for driving the liquid crystal display device, the liquid crystal display device, and an electronic apparatus incorporating the liquid crystal display device.

2. Description of the Related Art

In general, an active matrix type liquid crystal display device mainly consists of an element array substrate having a switching element provided on each of a plurality of pixel electrodes arranged in a matrix, an opposite substrate having a color filter or the like formed thereon, and a liquid crystal filling the space between the two substrates. In this structure, a liquid crystal layer is formed by each pixel electrode, the opposite substrate and the liquid crystal filling the space therebetween.

In the structure described above, applying an ON (selection state) signal onto a switching element leads to a conductive condition of that switching element. As a result, a predetermined amount of charge is stored in the liquid crystal layer connected to that switching element. Even when the switching element is brought into an OFF state by applying an OFF (non-selection state) signal after storage of the charge, stored charge in the liquid crystal layer is maintained, provided that the liquid crystal layer has a sufficiently high resistance. When the amount of stored charge is controlled by driving the individual switching elements, a change occurs in the alignment state of the liquid crystal for each pixel, thus permitting display of a predetermined information. At this point, because charge needs to be stored for each liquid crystal layer only during a portion of the period, it is possible to achieve multiplex driving using in common with the scanning lines and the data lines for the plurality of pixels by selecting individual scanning lines in a time-sharing manner.

Applicable switching elements are broadly classified into three-terminal type switching elements, such as a thin-film transistor (TFT: Thin Film Transistor) or an MOS type transistor, and two-terminal type switching elements, such as a thin-film diode (TFD: Thin Film Diode) having a non-linear characteristic. These three-terminal type and two-terminal type switching elements, having a non-linear current-voltage characteristic, are referred to also as non-linear elements.

According to the structure in which a supply of driving signal is discontinued simultaneously with the turning-off of the power supply, when turning off the power supply for a liquid crystal display device, the electric field, which has been applied to the liquid crystal layer at the moment of the stoppage of the driving signal, remains as it is, and the liquid crystal layer turns into a state that a DC voltage is applied thereto. If a DC voltage is continuously applied onto the liquid crystal layer in this state, material properties of the liquid crystal vary, leading to deterioration such as a reduced resistivity, and hence to a reduced service life of the liquid crystal display device. Therefore, it is desirable to adopt a structure in which at the time of the turning-off of the power supply for a liquid crystal display device, the supply of driving signals is continued until the charge stored in the liquid crystal layer reaches a null level.

However, because the discharge time constant of the stored charge is dependent upon various factors such as resistance and size of the pixel electrode, the material for the liquid crystal and the distance between the substrates, there is a problem that the period of time required for the charge stored in the liquid crystal layer to reach null varies for every different pixel and every liquid crystal display device. This means that the period over which the driving signals must be maintained after turning off the power supply is inconsistent and, hence, leads to a secondary problem of difficulty encountered in designing a driving signal supply circuit.

SUMMARY OF THE INVENTION

In view of the foregoing, an object of the present invention is to provide a method for controlling a liquid crystal display device, wherein liquid crystal layers are quickly cleared of any residual charge without dependency of the clearing time on individual devices, thereby suppressing degradation of the liquid crystal. The invention also is aimed at providing a device for driving the liquid crystal display device, the liquid crystal display device, and an apparatus incorporating the liquid crystal display device.

With a view in achieving the aforementioned object, the first aspect of the present invention provides a method for controlling a liquid crystal display device of the type in which desired images are displayed through control of charge amounts in liquid crystal layers of the liquid crystal display device, the method which may consist of detecting turning-off of a power supply connected to the liquid crystal display device; and upon detection of the turning-off of the power supply, electrically connecting the liquid crystal layer to a fixed potential.

According to this control method, the liquid crystal layer is connected to a fixed potential such as a grounding potential upon detecting the turning-off of the power supply. The liquid crystal layers are thus quickly cleared of the charges at a constant rate. As a result, a DC voltage is never applied on the liquid crystal for a long period of time, thus permitting prevention of deterioration of the liquid crystal. It is also possible to set a period of time ending when the charge stored in the liquid crystal layer becomes null without depending upon factors such as the resistance and size of the pixel electrode of the liquid crystal display panel, the material for the liquid crystal, and the distance between the substrates and so on.

Further, in the aforementioned controlling method of the liquid crystal display device, it is desirable to electrically connect the signal line, which applies a voltage onto the liquid crystal layer, to the foregoing fixed potential upon detecting the turning-off of the power supply. Removal of charges from the liquid crystal layers can indirectly be achieved even by such a simple measure as to connect the signal lines to the fixed potential.

Further, in the aforementioned controlling method of the liquid crystal display device, it is desirable to electrically connect the signal line, which is electrically connected to the liquid crystal layer, to a predetermined voltage supplying line, and to connect the predetermined voltage supplying line to the fixed potential, upon supplying the turning-off of the power supply. Removal of charges from the liquid crystal layers can indirectly be achieved by means of simple arrangement and control, using a switch that first connects the predetermined voltage supplying line to the signal lines which supply a voltage to the liquid crystal layers and then connects the predetermined voltage supplying line to the fixed potential.

In the aforementioned method of controlling the liquid crystal display device, the arrangement is preferably such that the predetermined voltage supplying line includes a first voltage supplying line for supplying a positive voltage relative to the fixed potential and a second voltage supplying line for supplying a negative voltage relative to the same, and that the signal lines are alternately connected to the first and second voltage supplying lines. Since there are thus provided the supplying lines that supplies the voltages that are positive and negative relative to the fixed potential, and these two supplying lines are alternately connected to the signal line and at the same time these two lines are connected to the fixed potential, it is possible to remove the charge from the liquid crystal layer as the positive and negative potentials of the supplying lines converge from positive and negative potentials toward the fixed potential. It is therefore possible to easily remove the charge irrespective of whether the liquid crystal layer stores positive charge or negative charge.

Further, in the controlling method of the aforementioned liquid crystal display device, the signal line should preferably be alternately connected to the first voltage supplying line and the second voltage supplying line in response to a clock signal having a period not longer than a ½ horizontal scanning period. Since connection of the supplying lines and signal line is switched over in response to the high-frequency clock, the stored charge of the liquid crystal layer can be discharged rapidly irrespective of the level of the stored charge in the liquid crystal layer.

Besides, the second aspect of the present invention provides a driving device for driving a liquid crystal display device that displays a desired image by controlling an amount of charge stored in a liquid crystal layer, including: a detecting circuit that detects the turning-off of a power supply; and connecting circuit that, upon detection of the turning-off of the power supply by the detecting circuit, connects the liquid crystal layer to a fixed potential.

According to this driving device, as in the first aspect of the invention, the liquid crystal layer is connected to the fixed potential, upon detection of turning-off of the power supply. The charge stored in the liquid crystal layer is thus cleared quickly at a constant rate. As a result, it is possible to set a period of time ending when the charge stored in the liquid crystal layer becomes null without depending upon such factors as the resistance and size of the electrodes of the liquid crystal display panel, the material for the liquid crystal, and the distance between the substrates.

This driving device should preferably have a structure in which the driving device further has a first connecting circuit that connects the liquid crystal layer to a predetermined line, and a second connecting circuit that connects the predetermined line to the fixed potential, upon detection of the turning-off of the power supply by the detecting circuit. As compared with the conventional structure in which predetermined scanning signals are supplied by switching over a plurality of lines, the structure according to the present invention suffices to add only a few elements.

The driving device should preferably have a structure in which the detecting circuit detects a source voltage lower than a threshold value as indicative of the turning-off of the power supply. In order to detect the turning-off of the power supply, an arrangement which monitors the source voltage can be employed most reliably.

The driving device of the liquid crystal display device according to the second aspect of the invention should preferably have a structure in which the connecting circuit is a switching circuit that connects the liquid crystal layer with a grounding conductor when the turning-off of the power supply is detected by the detecting circuit. This is the simplest structure.

Further, according to the driving device of the liquid crystal display device, the connecting circuit should preferably electrically connect the signal line that applies a voltage onto the liquid crystal layer, to the fixed potential. It is thus possible to remove the charge from the liquid crystal layer indirectly through a simple control, for example, connecting the signal line to the fixed potential.

Further, according to the driving device of the liquid crystal display device, the connecting circuit should preferably electrically connect the signal line that is electrically connected to the liquid crystal layer, to a predetermined line, and further connect the predetermined line to the fixed potential. Removal of charges from the liquid crystal layers can indirectly be achieved by means of simple arrangement and control, using a switch that first connects the predetermined voltage supplying line to the signal lines which supply a voltage to the liquid crystal layers and then connects the predetermined voltage supplying line to the fixed potential.

In the aforementioned method of controlling the liquid crystal display device, the arrangement is preferably such that the predetermined voltage supplying line includes a first voltage supplying line for supplying a positive voltage relative to the fixed potential and a second voltage supplying line for supplying a negative voltage relative to the same, and that the signal lines are alternately connected to the first and second voltage supplying lines. Since, there are thus provided the supplying lines supplying the voltages that are positive and negative voltage relative to the fixed potential, and these two supplying lines are alternately connected to the signal line, and at the same time these two supplying lines are connected to the fixed potential, the charge can be removed from the liquid crystal layer accordingly as the supplying lines converge from positive and negative potentials towards the fixed potential. It is thus possible to easily remove the charge irrespective of whether the stored charge of the liquid crystal layer is positive or negative.

Further, in the above-mentioned driving device of the liquid crystal display device, the signal line should preferably be alternately connected to the first voltage supplying line and the second voltage supplying line in response to a clock signal having a period not longer than a ½ horizontal scanning period. Since connection of the supplying lines and signal line is switched over in response to the high-frequency clock, the stored charge of the liquid crystal layer can rapidly be discharged irrespective of the level of the stored charge in the liquid crystal layer.

The liquid crystal display device according to the third aspect of the present invention is a liquid crystal display device that displays a desired image by controlling an amount of charge stored in a liquid crystal layer using a scanning signal and a data signal, the liquid crystal display device including: a detecting circuit that detects the turning-off of a power supply; a control circuit that controls connections to a predetermined line upon detection of the turning-off of the power supply by the detecting circuit; a first connecting circuit that, based on the instruction from the control circuit, connects one or both of a scanning line that receives the supplied scanning signal and a data line that receives the supplied data signal, to the predetermined line; and a second connecting circuit that, upon detection of the turning-off of the power supply by the detecting circuit, connects the predetermined line to a fixed potential.

According to this liquid crystal display device, as in first aspect of the invention, the liquid crystal layer is connected to the fixed potential upon detection of the turning-off of the power supply. The charge stored in the liquid crystal layer is thus cleared quickly and at a constant speed. As a result, it is possible to set a period of time ending when the charge stored in the liquid crystal layer becomes null without depending upon such factors as the resistance and size of the electrode of the liquid crystal display panel, the material for the liquid crystal, and the distance between the substrates and so on.

The liquid crystal display device according to the third aspect of the invention includes a liquid crystal display panel having one substrate provided with a data line thereon, another substrate provided with a scanning line thereon, and a plurality of pixels each having a series connection of a non-linear element and a liquid crystal layer between the data line and the scanning line; a detecting circuit detecting turning-off of a power supply; and a switching circuit that connects a supplying line of a selection voltage applied onto the scanning line to a grounding conductor upon detection of the turning-off of the power supply by the detecting circuit.

According to this liquid crystal display device, the supplying line having a selection voltage that is applied onto the scanning line upon writing a data signal on pixels is connected to a grounding conductor, upon detection of the turning-off of the power supply. Thus, the charge stored in the liquid crystal layer is discharged quickly and at a constant rate. Particularly, the selection voltage is a voltage that turns a two-terminal type non-linear element on. It is therefore possible to remove the charge from the liquid crystal layer by turning on the non-linear element without causing a decrease in the selection voltage, immediately after the detection of the turning-off of the power supply. As a result, it is possible to set a period of time ending when the charge stored in the liquid crystal layer becomes null, without depending upon such factors as the resistance and size of the pixel electrode, the material for the liquid crystal, and the distance between the substrates.

Further, in the aforementioned liquid crystal display device, the switching circuit should preferably connect the scanning line to the supplying line supplying a voltage for turning on the non-linear element, and connect the supplying line to a grounding conductor upon detection of a turning-off of the power supply. Removal of charges from the liquid crystal layers can indirectly be achieved by means of simple arrangement and control, using a switch that first connects the predetermined voltage supplying line to the signal lines which supply a voltage to the liquid crystal layers and then connects the predetermined voltage supplying line to the fixed potential.

Further, in the above-described liquid crystal display device, the supplying line should preferably comprise a first supplying line for supplying a positive selection voltage relative to the grounding potential and a second supplying line for supplying a negative selection voltage relative to the grounding potential. The scanning line should preferably be alternately connected to the first supplying line and the second supplying line. Because there are two supplying lines employed for positive and negative voltages, respectively, relative to the grounding potential, these two supplying lines are alternately connected to the signal line, and at the same time these two supplying lines are connected to the grounding potential, the charge of the liquid crystal layer can be removed as the supplying lines converge from positive and negative potentials into the grounding potential. It is therefore possible to easily remove the charge irrespective of whether the charge of the liquid crystal layer is positive or negative.

In the liquid crystal display device according to the third aspect of the invention, the non-linear element should preferably be a two-terminal type non-linear element, and further, the two-terminal type non-linear element should preferably be a thin film diode (TFD) element having a first metal, an insulator, and a second metal.

This structure is preferred because a short circuit defect between wiring lines does not occur in principle in a two-terminal type non-linear element such as the TFD element because of the absence of a crossing portion of the wirings, and further, the film forming step and the photolithographic step can be shortened.

The liquid crystal display device of the invention may also consist of a liquid crystal display panel having a liquid crystal layer sandwiched between a substrate provided with a data line and another substrate provided with a scanning line, a detecting circuit detecting a turning-off of the power supply, and a switch circuit connecting the voltage supplying line, which applies a voltage onto the scanning line or the data line, to a prescribed constant potential upon detection of a turning-off of the power supply by the detecting circuit.

According to the passive type liquid crystal display device in which the electric field applied to the liquid crystal layer is controlled only by a pair of opposite electrodes sandwiching the liquid crystal layer therebetween, and the pixels do not have non-linear elements, the supplying line having supplied a voltage to the scanning line or to the data line is connected to a prescribed constant potential upon detection of a power supply turning-off. As a result, the charge stored in the liquid crystal layer is rapidly removed at a certain rate directly through the scanning line or the data line. It is therefore possible to determine the period of time ending when the stored charge of the liquid crystal layer reach a null level without depending upon such factors as the resistance and size of the electrode, the material of the liquid crystal, and the distance between the substrates.

Further, in the aforementioned liquid crystal display device, the scanning line or the data line should preferably be connected, upon detection of the turning-off of the power supply, to the first supplying line for supplying a positive voltage to the prescribed constant potential and to the second supplying line for supplying a negative voltage, alternately. Further, the switching circuit should preferably connect the first supplying line and the second supplying line to a predetermined constant potential. Since, there are thus provided the supplying lines supplying the voltages that are positive and negative voltage relative to the fixed potential, these two supplying lines are alternately connected to the signal line, and at the same time these two supplying lines are connected to the constant potential, the charge stored in the liquid crystal layer can be removed as the supplying lines converge from positive and negative potentials toward the constant potential. It is therefore possible to easily remove the charge irrespective of whether the charge stored in the liquid crystal layer is positive or negative.

Besides, the fourth aspect of the present invention provides an electronic apparatus incorporating the above-described liquid crystal display device, for example, a car navigation system, a portable information terminal device and various other electronic apparatuses.

BRIEF DESCRIPTION OF THE DRAWINGS

FIG. 1(*b*) is a sectional view taken along the line A—A of FIG. 1(*a*);

FIG. 3(*b*) is a sectional view taken along the line B—B of FIG. 3(*a*);

DETAILED DESCRIPTION OF PREFERRED EMBODIMENTS

Embodiments of the present invention will now be described with reference to the drawings.

<Liquid Crystal Display Device of First Embodiment>

[Example of TFD Element]

The structure of a non-linear element (switching element) driving each liquid crystal pixel in the liquid crystal display device of this embodiment will be briefly described with a two-terminal non-linear element such as a TFD element by way of an example. In the invention, the non-linear element is not limited to a TFD element, but may of course be a three-terminal type switching element such as a TFT element or an MOS type transistor.

Figure 1A:
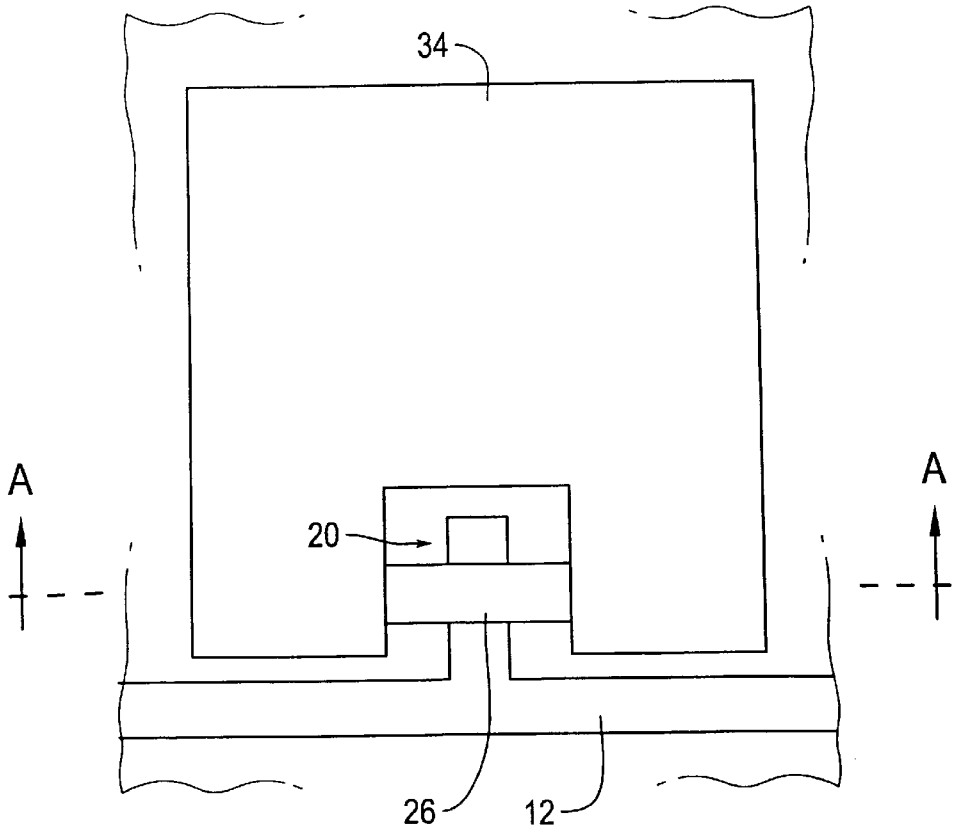
FIG. 1(*a*) is a plan view illustrating a layout for a pixel of a substrate for a liquid crystal display panel incorporating a TFD element.
Figure 1B:
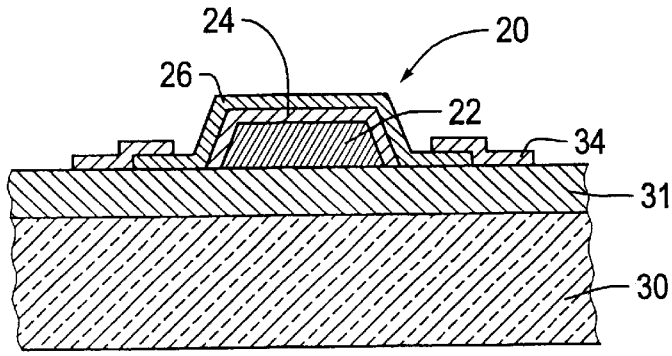

FIG. 1(*a*) is a plan view illustrating a layout for a single pixel in a liquid crystal panel substrate incorporating the TFD element; and FIG. 1(*b*) is a sectional view of the structure of the TFD element shown in FIG. 1(*a*) taken along the line A—A.

As shown in these Figures, the TFD element 20 is formed on the upper surface of an insulating film 31 which is formed on a substrate 30. The TFD element 20 is composed of a first metal film 22, an insulating oxide film 24, and a second metal film 26 which are sequentially formed on the insulating film 31, thus forming a metal-insulator-metal sandwich structure. By virtue of this structure, the TFD element 20 has a diode switching characteristic both in the positive and negative directions.

The first metal film 22 composing the TFD element 20 becomes a scanning line 12 as one terminal, and the second metal film 26 is connected to a pixel electrode 34 as the other terminal. The wiring line 12 may also be used as the data line, instead of being used as the scanning line. In such a case, the arrangement may be such that the data signal is applied to the pixel electrode 34 via the data line 12 and the TFD element 20.

The substrate 30 has an insulation and a transparency, and is formed of, for example, glass or plastics. The insulating film 31 is provided for the purpose of preventing the first metal film 22 from peeling off the undercoat during a heat treatment applied after deposition of the second metal film 26, and also, preventing diffusion of impurities into the first metal film 22. When these inconveniences can be disregarded, therefore, the insulating film 31 may be omitted.

The first metal film 22 is a conductive metal thin film, consisting of, example, tantalum alone or a tantalum alloy.

The oxide film 24 is an insulating film formed by anodically oxidizing the surface of, for example, the first metal film 22 in a chemical liquid.

The second metal film 26 is a conductive metal thin film, and consists of, for example, chromium alone or a chromium alloy.

The pixel electrode 34 has a transparent conductive film such as an ITO (Indium Tin Oxide) when used for a transmissive-type liquid crystal display panel, and a metal film having a large light reflectivity such as aluminum or silver when applied for a reflective-type liquid crystal display panel.

[Other Examples of TFD Element]

Other examples of the TFD element will now be described.

(Use Common to Second Metal Film and Pixel Electrode)

Figure 2:
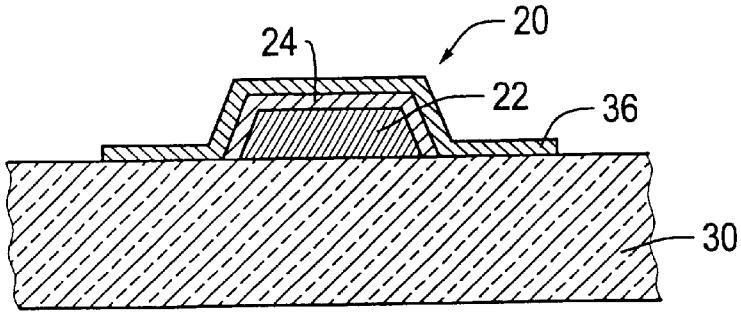
FIG. 2 is a sectional view illustrating the structure of another TFD element.

In the TFD element 20 shown in FIGS. 1(*a*) and 1(*b*), the second metal film 26 and the pixel electrode 34 are made of different metal films. As shown in the sectional view illustrated in FIG. 2, the second metal film and the pixel electrode may be made of transparent conductive films 36 consisting of the same ITO film or the like. The TFD element 20 having such a structure is advantageous in that the second metal film 26 and the pixel electrode 34 can be formed in a single step of the process. In FIG. 2, the components corresponding to those in FIGS. 1(*a*)–(*b*) are assigned the same reference numerals, and description thereof is omitted.

(Back-To-Back Structure)

Figure 3A:
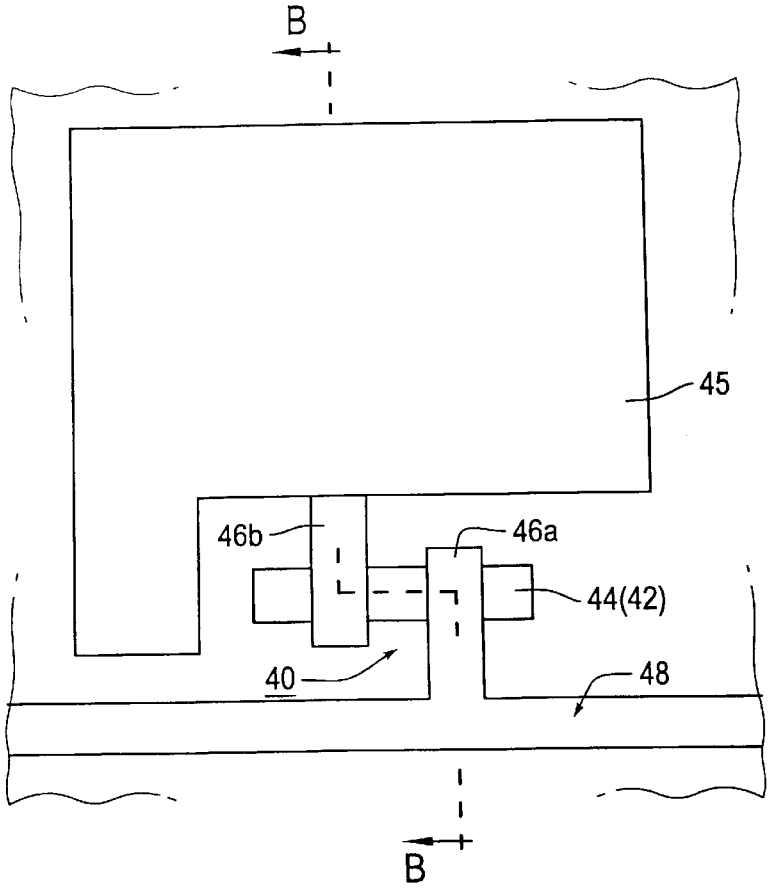
FIG. 3(*a*) is a plan view illustrating a layout for a pixel of a substrate for a liquid crystal display panel incorporating another TFD element.
Figure 3B:
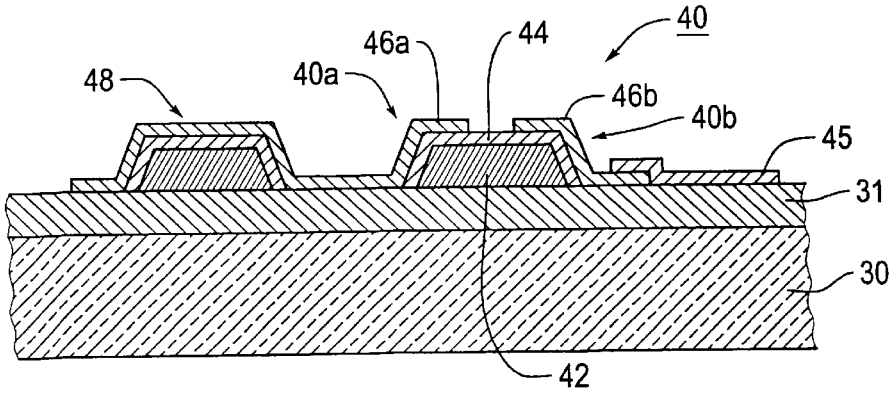

The back-to-back structured TFD element will now be described as another example of TFD element. FIG. 3(*a*) is a plan view illustrating a layout for a single pixel in a liquid crystal panel substrate incorporating this TFD element; and FIG. 3(*b*) is a sectional view illustrating the structure of the TFD element, taken along the line B—B. In FIGS. 3(*a*)–(*b*) the components corresponding to those in FIGS. 1 (*a*)–(*b*) are assigned the same reference numerals, and description thereof is omitted.

The back-to-back structure is a structure in which two diodes are connected in series in directions counter to each other to make the non-linear characteristic symmetrical both in the positive and negative directions. As a result, the TFD element 40 has a structure in which a first TFD element portion 40*a* and a second TFD portion 40*b* are connected in series with polarities counter to each other as shown in FIG. 3(*b*). More specifically, it consists of the substrate 30, the insulating film 31 formed on the surface thereof, a first metal film 42, an oxide film 44 formed on the surface thereof through anodic oxidation, and second metal films 46*a* and 46*b* formed on the surface thereof and spaced apart from each other.

The second metal film 46*a* in the first TFD element portion 40*a* serves as a scanning line 48, whereas the second metal film 46*b* in the second TFD element portion 40*b* is connected to a pixel electrode 45. The oxide film 44 is formed into a smaller thickness of, for example, about a half, as compared to the oxide film 24 in the TFD element 20 shown in FIG. 1(*b*). The detailed configuration of such components as the first metal film 42, the oxide film 44, and second metal films 46*a* and 46*b* are the same as in the above-mentioned TFD element 20. The description thereof is therefore omitted.

Apart from the above, the symmetricity of non-linear characteristic can be ensured also by a ring-shaped element formed by connecting two diodes in parallel in directions counter to each other.

[Embodiments of Liquid Crystal Display Device]

Figure 4:
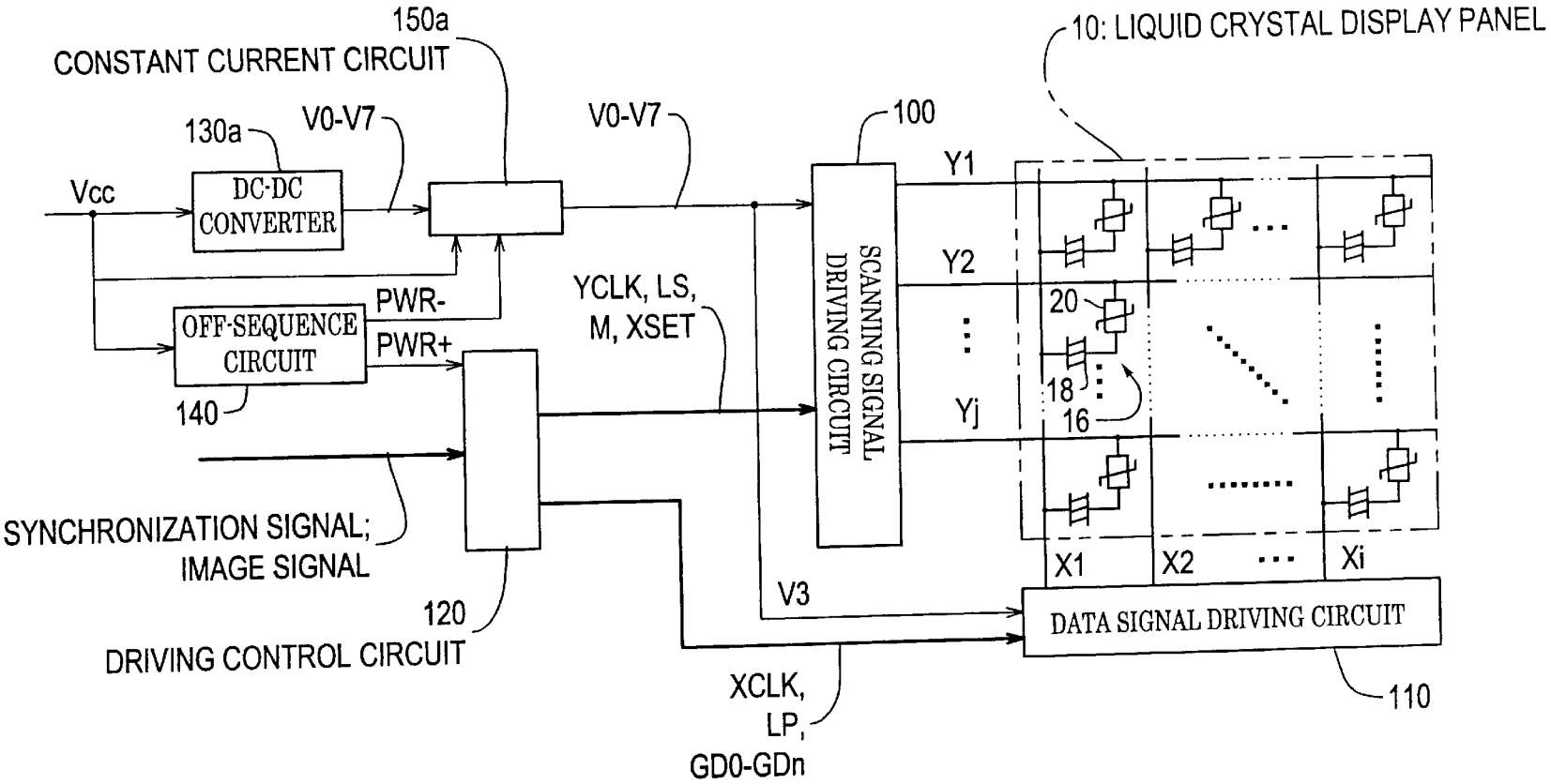
FIG. 4 is a block diagram illustrating a critical structure of a liquid crystal display device of a first embodiment of the present invention.

The liquid crystal display device of an embodiment in which the aforementioned TFD element 20 is used as a two-terminal type non-linear element will now be described. FIG. 4 is a block diagram schematically illustrating a part of the structure of the liquid crystal display device of the first embodiment.

In the liquid crystal display panel 10, as shown in FIG. 4, pixel areas 16 are formed at points of intersection of i data line X1 to Xi and j scanning lines Y1 to Yj. Each pixel 16 has a configuration in which a liquid crystal display element (liquid crystal layer) 18 and a two-terminal type non-linear element 20 are connected in series. Each one of the scanning lines Y1 to Yj in FIG. 4 is the same as the scanning line 12 in FIG. 1(*a*).

The scanning lines Y1 to Yj are driven by a scanning signal driving circuit 100, while the data lines X1 to Xi are driven by a data signal driving circuit 110. Further, the scanning signal driving circuit 100 and the data signal driving circuit 110 are controlled by a driving control circuit 120.

In FIG. 4, the TFD element 20 is connected to the scanning line side, and the liquid crystal layer 18 is connected to the data line side. Conversely, as described above, the arrangement may be such that the TFD element 20 is arranged on the data line side and connected to the data line; and a scanning line is provided to face the TFD element 20 across the liquid crystal layer 18.

A DC-DC converter 130*a* receives a source voltage Vcc to generate and output voltages V0 to V7 used in the liquid crystal display device. In this embodiment, the source voltage Vcc is a voltage of, for example, 12 V. An off-sequence circuit 140*a* is a circuit which detects a drop in the source voltage Vcc caused by turning off the power supply to the liquid crystal display device such that when the source voltage Vcc decreases below a threshold voltage Vth, the off-sequence circuit 140*a* causes the levels of signals PWR– and PWR+ to transit. A constant current circuit 150*a* connects the voltage supplying lines of voltages V1 and V6 out of the voltage supplying lines which are supplied with voltages V0 to V7 from the DC-DC converter 130*a*, to the grounding conductor in response to the level transition of the signal PWR –or PWR+. The grounding conductor is at a stable grounding potential irrespective of a power supply turning-on or turning-off, and is therefore most suitable as a fixed potential for receiving the charge released from the liquid crystal layer. From among the components shown in FIG. 4, the liquid crystal display panel 10, the scanning signal driving circuit 100, the data signal driving circuit 110, the driving control circuit 120, the off-sequence circuit 140 and the constant current circuit 150*a* will be sequentially described in detail.

[Liquid Crystal Display Panel]

Figure 5:
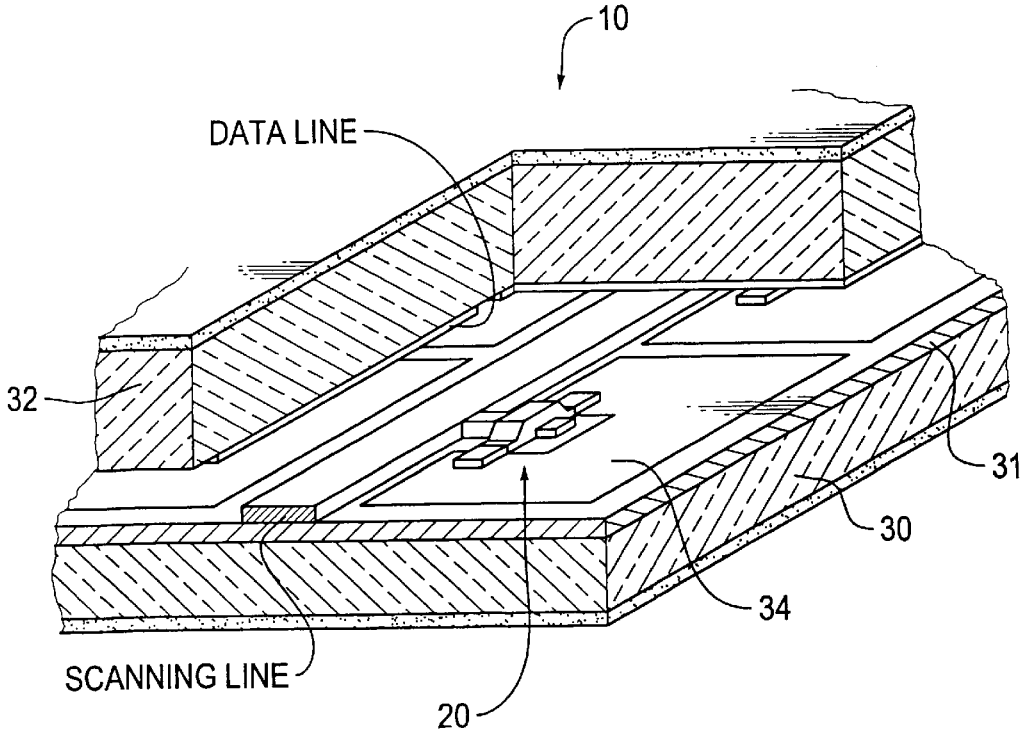
FIG. 5 is a partially cut-away perspective view illustrating the structure of the liquid crystal display panel.

First, details of the liquid crystal display panel 10 will be described. FIG. 5 is a partially cutaway perspective view schematically illustrating a typical example.

As shown in FIG. 5, the liquid crystal display panel 10 has an element array substrate 30 and a counter substrate 32 arranged opposing thereto. The counter substrate 32 consists of, for example, a glass substrate.

On the element array substrate 30, a plurality of pixel electrodes 34 are arranged in a matrix. Each of the pixel electrodes 34 arranged in the same row is connected to one of the scanning lines Y1 to Yj extending in a strip in the row direction via the TFD element 20 having a construction shown in FIGS. 1*a* to 3*b*. The construction of the TFD element shown in FIG. 5 is similar to that shown in FIGS. 1(*a*)–(*b*) except that the second metal film is arranged on top of the pixel electrode 34. On the counter substrate 32, on the other hand, i data lines X1 to Xi extend in a strip in a column direction at right angles to the extending direction of the scanning lines Y1 to Yj, and are formed so as to cross the pixel electrodes 34 of the element array substrate 30 with the liquid crystal layer in between. The element array substrate 30 and the counter substrate 32 having the structure as described above are spaced apart by a certain gap by a sealing agent coated along the peripheries of the substrates and by spacers dispersed appropriately. For example, a TN (Twisted Nematic) type liquid crystal is sealed in this closed space, thereby forming the liquid crystal layer 18 shown in FIG. 4.

Further, on the counter substrate 32, color filters are arranged, for example, in stripes, in a mosaic shape, or in a triangular shape according to the use of the liquid crystal display panel 10. In addition, there is provided a black matrix such as a resin black prepared by dispersing, in a photoresist, a metal, e.g., chromium, or nickel, carbon, or titanium. In addition, alignment layers rubbed in predetermined directions are provided on the opposing surfaces of the element array substrate 30 and the counter substrate 32 which oppose each other across the liquid crystal layer, whereas the back (outer) surface side of the substrates are provided with polarizers corresponding to the directions of alignment of the alignment layers (both the alignment layers and the polarizers are not shown).

However, in the liquid crystal display panel 10, use of a polymer dispersion type liquid crystal in which the liquid crystal in the form of fine particles is dispersed in a polymer eliminates the necessity of the aforesaid alignment layer and polarizer or the like. This improves the optical utilization ratio, and is favorable in terms of achievement of a higher luminance and a lower power consumption of the liquid crystal display panel. When a reflection type liquid crystal display panel 10 is adopted, the pixel electrodes 34 may be made of a metal film having a high reflectivity such as aluminum, and an SH (super homeotropic) type liquid crystal, in which liquid crystal molecules are aligned substantially vertically in a voltage non-applied state, may be used in place of a TN type liquid crystal. When using a reflection type pixel electrode 34, it suffices to arrange the polarization plate only on the outside of the counter substrate 32.

As described above, the scanning line on the element array substrate 30 and the data line on the counter substrate 32 shown in FIG. 5 may be replaced with each other.

[Scanning Signal Driving Circuit]

The scanning signal driving circuit 100 for supplying a scanning signal to the liquid crystal display panel 10 will now be described in detail.

Figure 6:
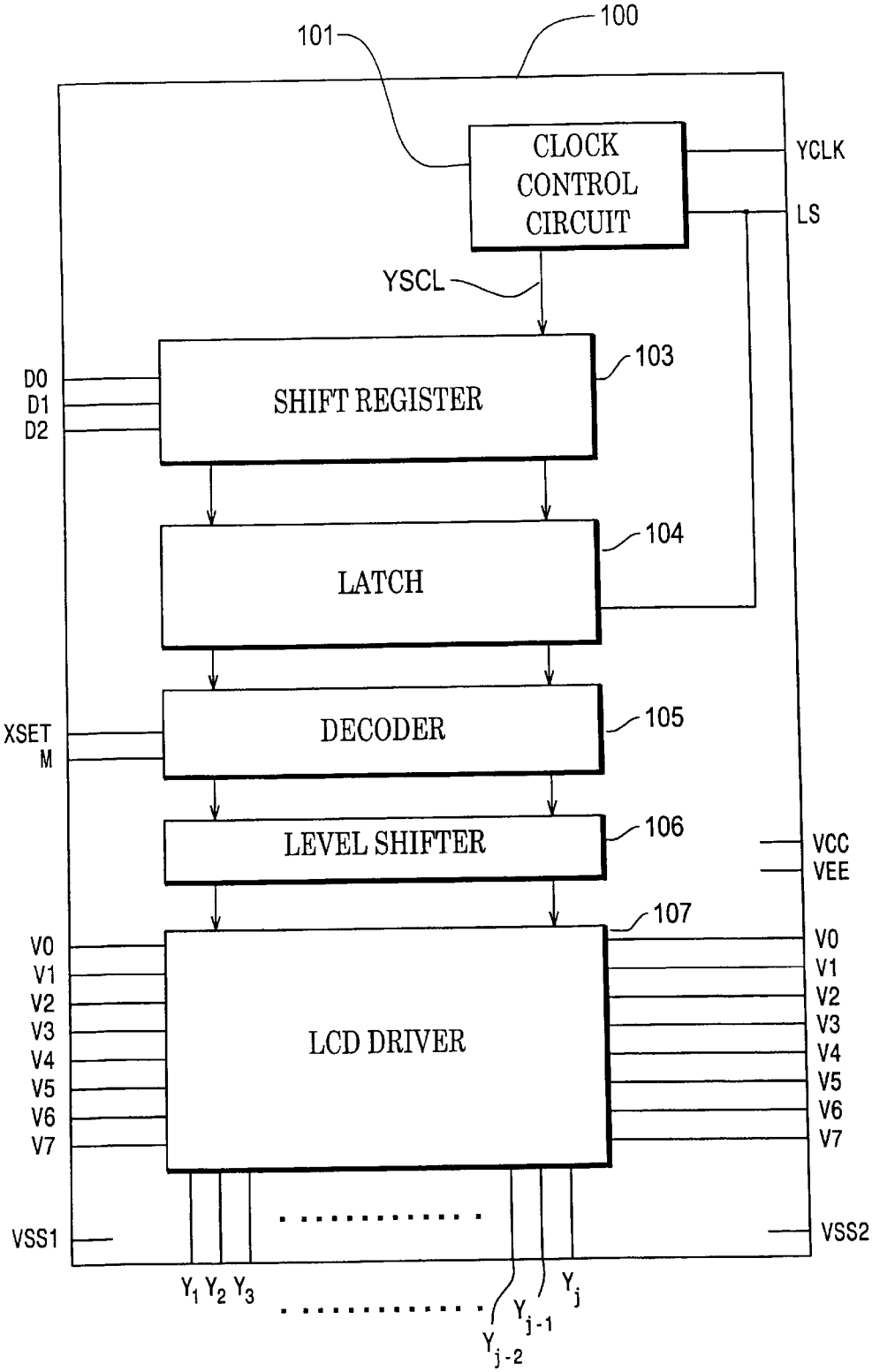
FIG. 6 is a block diagram illustrating the detail of the structure of the scanning signal driving circuit.

As shown in FIG. 6, the scanning signal driving circuit 100 may mainly cosist of a clock control circuit 101, a shift register 103, a latch 104, a decoder 105, a level shifter 106 and an LCD driver 107.

Figure 7:
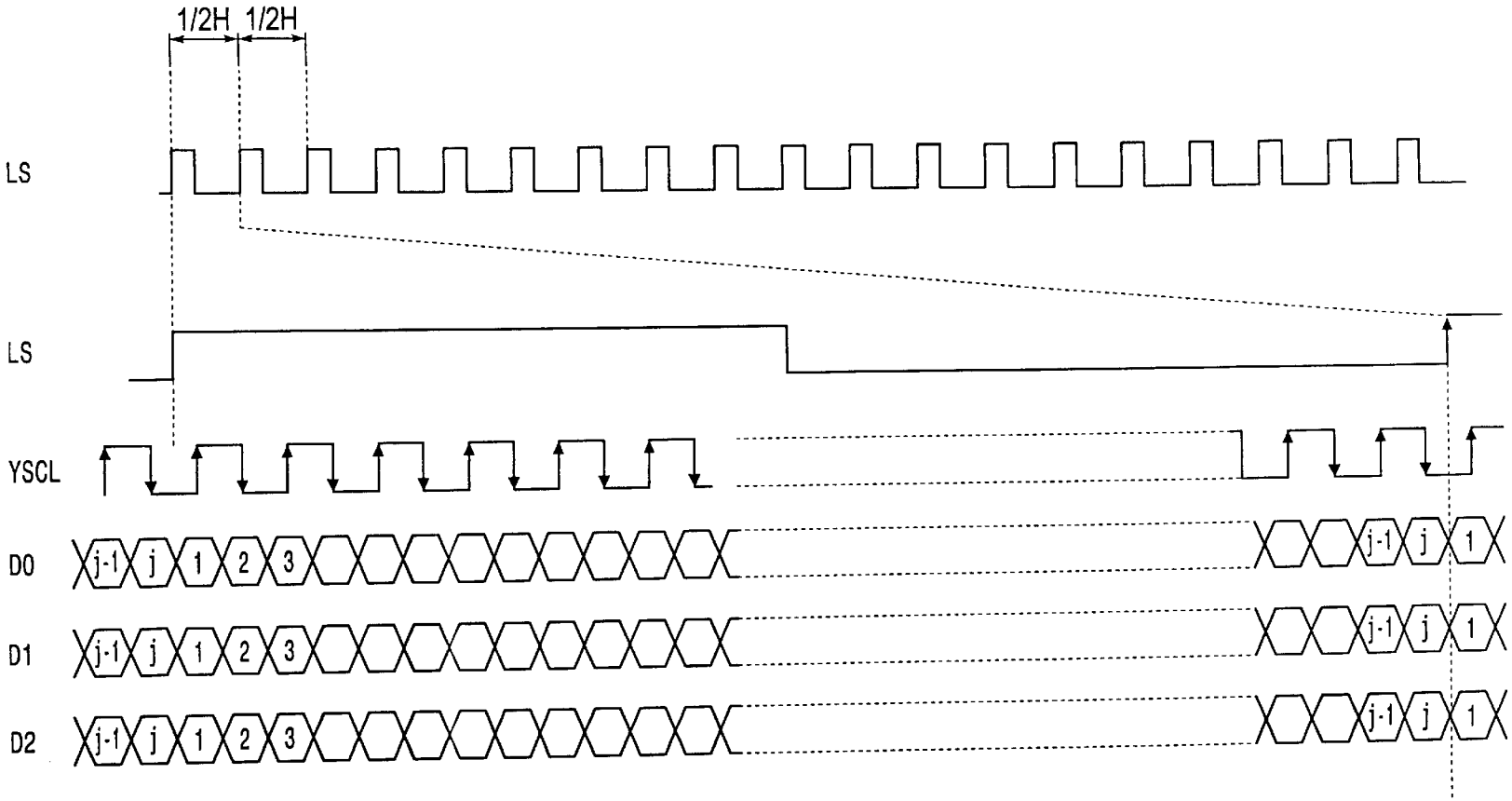
FIG. 7 is a timing chart illustrating an operation incorporating data in the scanning signal driving circuit.

Among these components, the clock control circuit 101 generates a shift clock signal YSCL for data shift as shown in FIG. 7 on the basis of a scanning side clock signal YCLK output from the driving control circuit 120, and supplies it to the shift register 103. The shift clock signal YSCL is a signal having the same period as the scanning side clock signal YCLK with a phase shift therefrom. The shift register 103 has a configuration in which shift registers having j-bit parallel outputs corresponding to the number of scanning lines Y1 to Yj are provided in three independent columns in correspondence to each of input data D0, D1 and D2. As a result, the shift register 103 performs 3-bit output for each of the scanning lines Y1 to Yj. The input data D0, D1 and D2 are data for selecting a voltage for each of the scanning lines Y1 to Yj, which are output from the driving control circuit 120 as serial data, respectively. The shift clock signal YSCL is supplied to each of the shift registers forming the shift register 103 so that these shift registers incorporate respective data at the leading edge timing and at the trailing edge timing of the shift clock signal YSCL, and sequentially shift the thus incorporated data as shown in FIG. 7.

The latch 104 has three columns of latches incorporating data for j bits, and has a configuration in which it incorporates parallel output data multiplied 3-column by j-bit as output from the shift register 103 at the leading edge timing of a latch strobe signal LS into three-column multiplied by j-bit latches. The latch strobe signal LS is a signal supplied from the driving control circuit 120 which rises up at a predetermined timing after incorporation of data for j bits by the respective shift registers composing the shift register 103.

At the leading edge timing of the latch strobe signal LS, therefore, the serial data D0, D1 and D2 output from the driving control circuit 120 are converted into 3-bit parallel data for each of the scanning lines Y1 to Yj and output from the latch 104.

When a signal XSET supplied from the driving control circuit 120 is on a usual H-level, the decoder 105 decodes 3-bit parallel data to convert the 3-bit parallel data into a signal for selecting any of the voltages V0 to V7 as a voltage for the selection signal. However, when the signal XSET transfers to an L-level as a result of turning off the power supply in the liquid crystal display device, the decoder 105 outputs a signal for forcedly selecting a voltage V1 when the signal M supplied from the driving control circuit 120 is on the H-level, and a voltage V6 when the signal M is on the L-level. The signal M is a signal which determines the liquid crystal driving polarity in the charge mode or in the discharge mode.

The level shifter 106 sequentially shifts signals decoded by the decoder 105.

The LCD driver 107 selects and outputs any of the eight kinds of voltage V0 to V7 supplied from the DC-DC converter 130*a* in FIG. 4 for each of the scanning signals Y1 to Yj in response to the signal shifted by the level shifter 107. As a result, one of the eight voltages V0 to V7, selected in accordance with data D0 to D2 in each ½ period (½ H) of the horizontal scan period, is supplied as the scanning signal to each of the scanning lines Y1 to Yj.

Figures 8, 9:
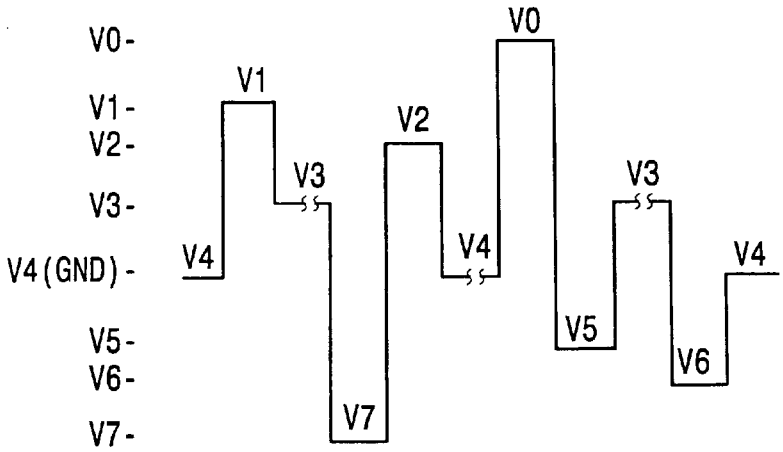
FIG. 8 is a table showing the relationship between parallel data D0, D1 and D2 supplied to the scanning signal driving circuit and the output voltage.
FIG. 9 is a chart illustrating the relative extent of each output voltage.

When combinations of values of the 3-bit parallel data D0, D1 and D2 output from the latch 104 and the kinds of selection signal voltage V0 to V7 are in the corresponding relationship as shown in FIG. 8, it becomes possible to select and sequentially output a voltage having a magnitude as shown in FIG. 9 as a scanning signal for each of the scanning lines Y1 to Yj from the LCD driver 107, by first decoding the 3-bit parallel data into a signal for selecting any of the kinds of voltage V0 to V7 by means of the decoder 105, and then, shifting it via the level shifter 106.

Figure 10:
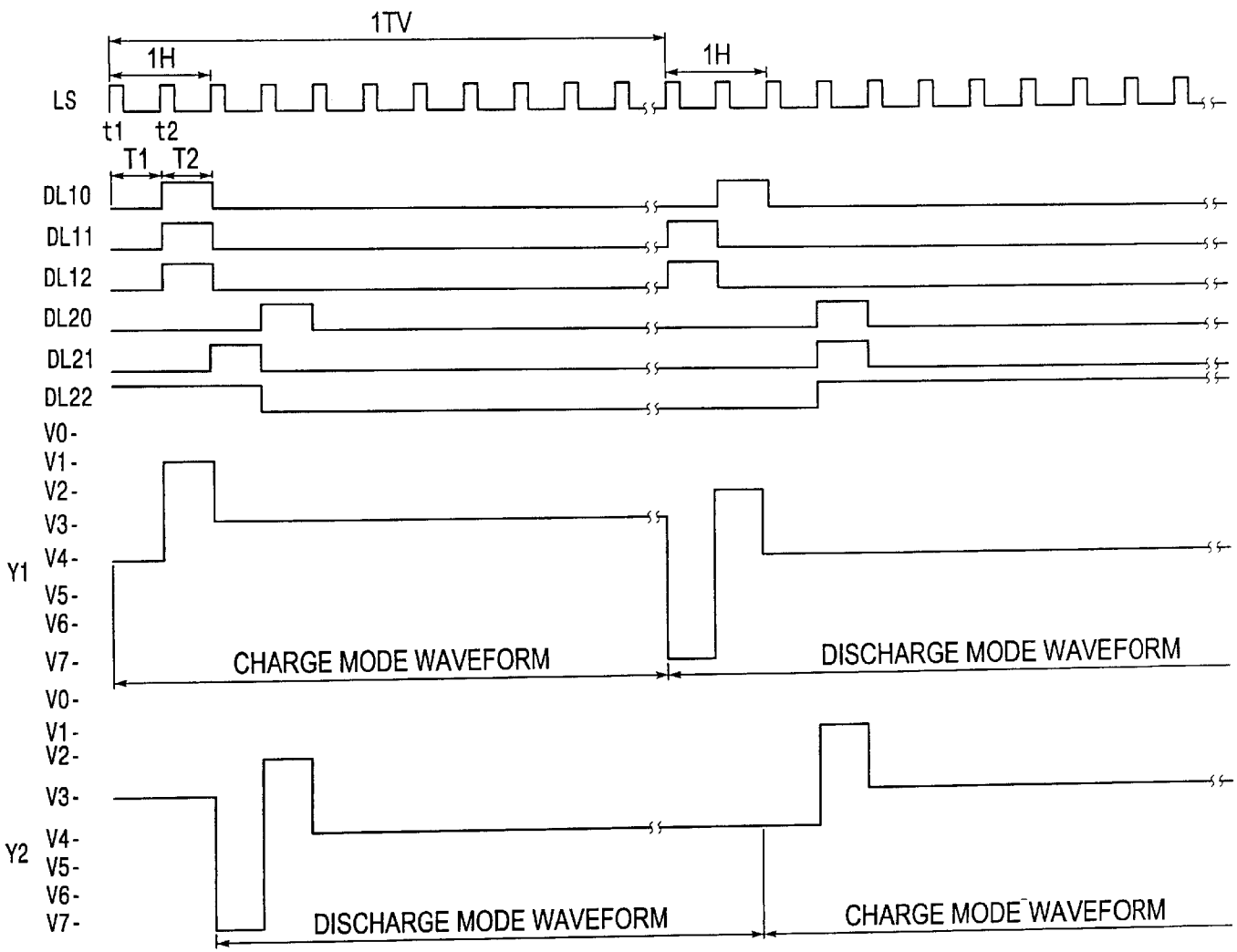
FIG. 10 is a view illustrating the voltage waveform indicative of the output operation of the scanning signal by the scanning signal driving circuit.

When the outputs of the latch 104 corresponding to the scanning line Y1 are expressed as DL10, DL11 and DL12 to correspond to the data D0, D1 and D2, and outputs of the latch 104 corresponding to the scanning line Y2 are expressed as DL20, DL21 and DL22 to correspond to the data D0, D1 and D2, if it is assumed that, as shown in FIG. 10, (DL10, DL11, DL12) and (DL20, DL21, DL22) take values of (0, 0, 0) and (0, 0, 1), respectively, at the leading edge timing t1 of the latch strobe signal LS, then, the voltage of the scanning line Y1 is V4 in the period T1, and the scanning line Y2 has a voltage V3.

Similarly, if values (DL10, DL11, DL12) and (DL20, DL21, DL22) are (1, 1, 1) and (0, 0, 1), respectively, at the leading edge timing t2 of the latch strobe signal LS, then, voltage of the scanning line Y1 is V1, while voltage of the scanning line Y2 remains V3. In FIG. 10, only one polarity of the scanning signal in each of the charge mode and the discharge mode is shown for the convenience of explanation. This scanning signal driving circuit 100 permits separate driving of the scanning signal in the charge mode and the discharge mode, and further, driving the two modes with both the positive and negative polarities.

[Data Signal Driving Circuit]

The data signal driving circuit 110 for supplying a data signal to the liquid crystal display panel 10 will now be described in detail.

Figure 11:
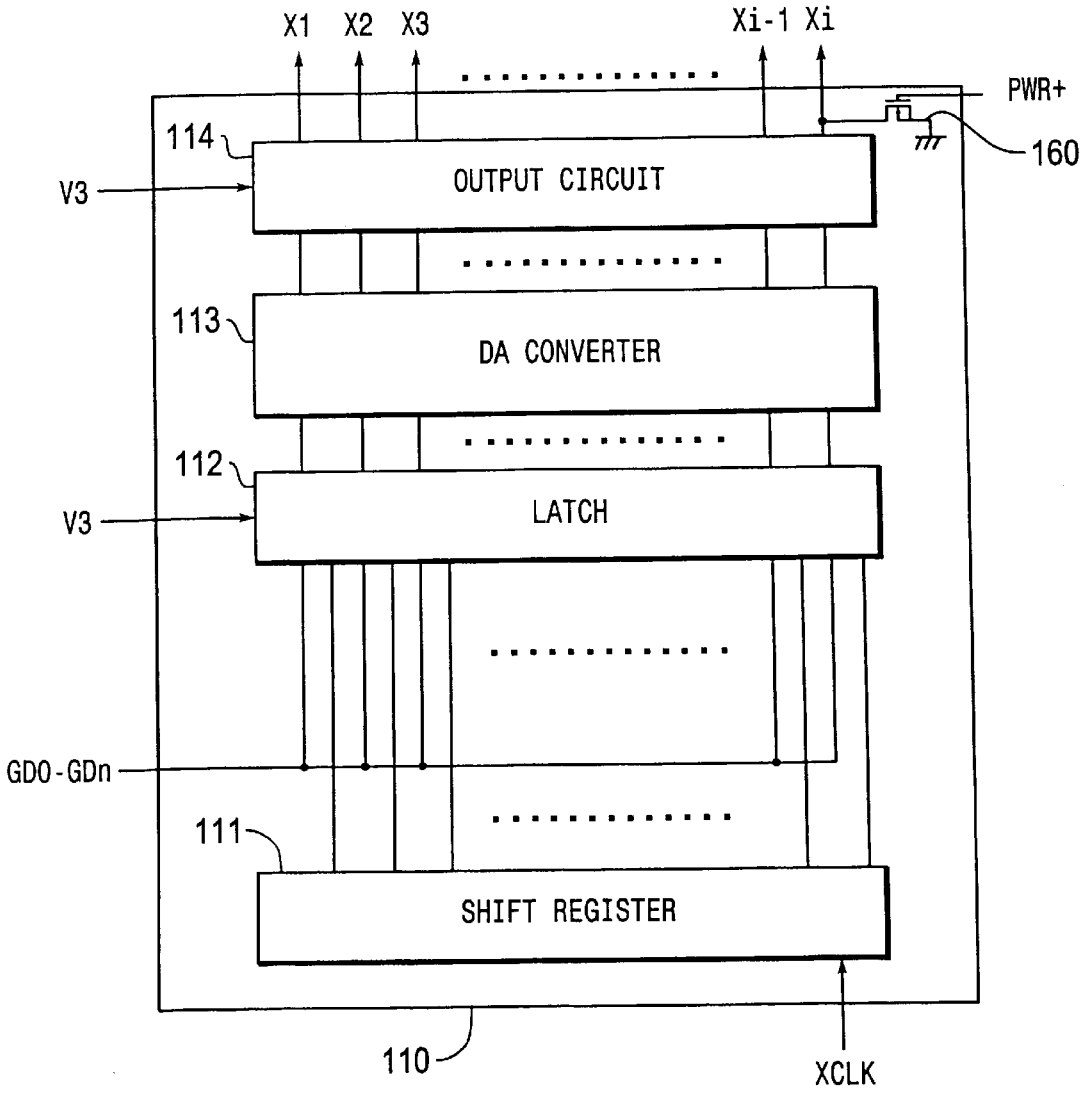
FIG. 11 is a block diagram illustrating the detail of the structure of the data signal driving circuit.

As shown in FIG. 11, the data signal driving circuit 110 may mainly consist of a shift register 111, a latch 112, a DA converter 113 and an output circuit 114.

Among these components, the shift register 111 sequentially shifts and outputs latch signals which correspond to the individual data signal output terminals X1 to Xi in synchronization with the clock signal XCLK.

The latch 112 is provided with i-bit latch areas corresponding to the respective data signal output terminals X1 to Xi. The individual latch areas latch n-bit serial gray scale data GD0 to GDn supplied every n bits in the sequence of the data lines by means of latch signals from the shift register 111, and output the latched data at the leading edge timing of a latch pulse signal LP in synchronization with a horizontal synchronization signal.

The gray scale data GD0 to GDn, the clock signal XCLK and latch pulse signal LP are supplied while being correlated with each other by the driving control circuit 120. The individual areas of the latch 112 therefore incorporate gray scale data GD0 to GDn to be supplied to their associated data lines from among the serially supplied gray scale data, and output the data to the respective data lines at the leading edge timing of the latch pulse signal LP.

The DA converter 113 converts respective gray scale data corresponding to the individual data lines into analog signals, and supplies them to the output circuit 114.

The output circuit 114 is a buffer for current-amplifying an analog signal converted by the DA converter 113, and performs voltage-modulation-output of the gray scale data. Data signals voltage-modulated in response to the respective gray scales are therefore output from the respective data signal output terminals X1 to Xi.

The gray-scale data from the latch 112 are provided at the leading edge timing of the latch pulse signal LP synchronized with the horizontal synchronization signal, so that the data signal is output from the output circuit 114 to the data lines every one horizontal scanning period. As described above, however, the voltage determining a display condition of the liquid crystal (voltage V1 or V2 in FIG. 10) is output every half of the horizontal scanning period in each of the charge mode and discharge mode. The data signal is therefore output every half of the horizontal scanning period corresponding to the above-mentioned voltage.

[Driving Control Circuit]

Details of the driving control circuit 120 will now be described.

Figure 12:
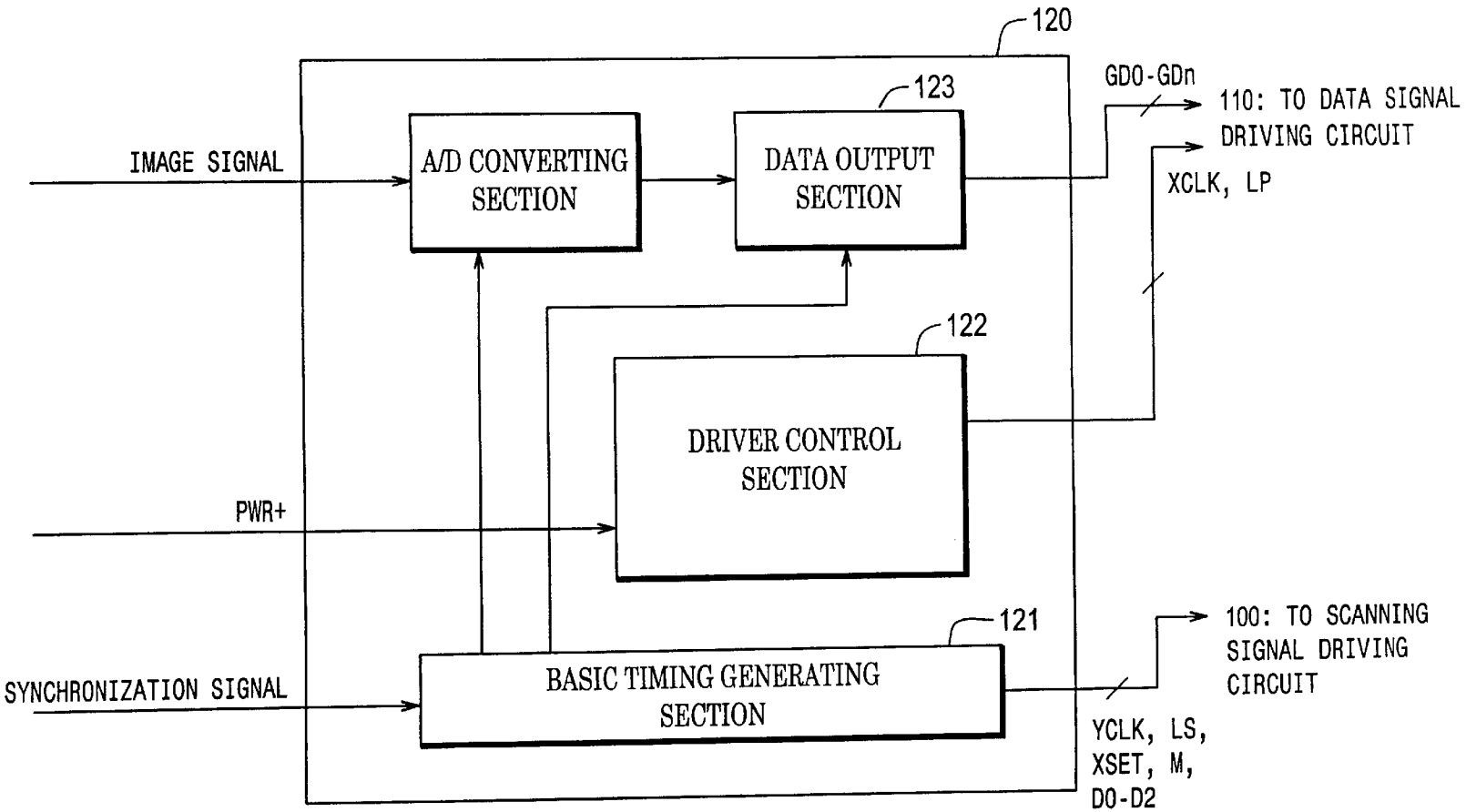
FIG. 12 is a block diagram illustrating the detail of the structure of the driving control circuit.
Figure 13A:
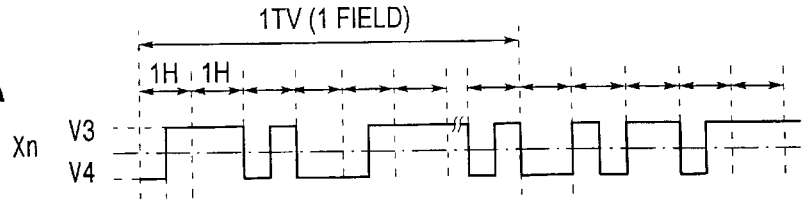
FIGS. 13(*a*) to 13(*d*) are driving waveform charts illustrating driving examples of a liquid crystal display panel.
Figure 13B:
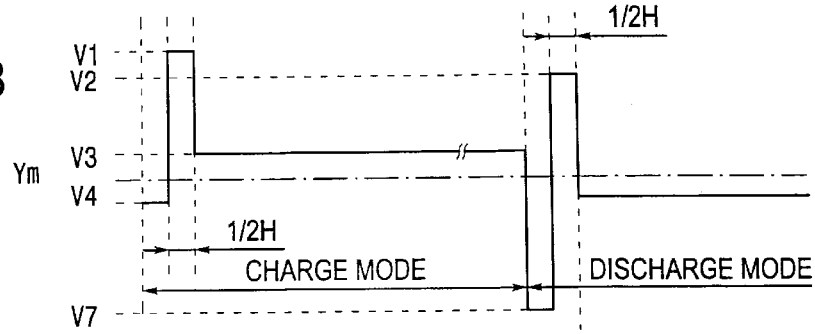
Figure 13C:
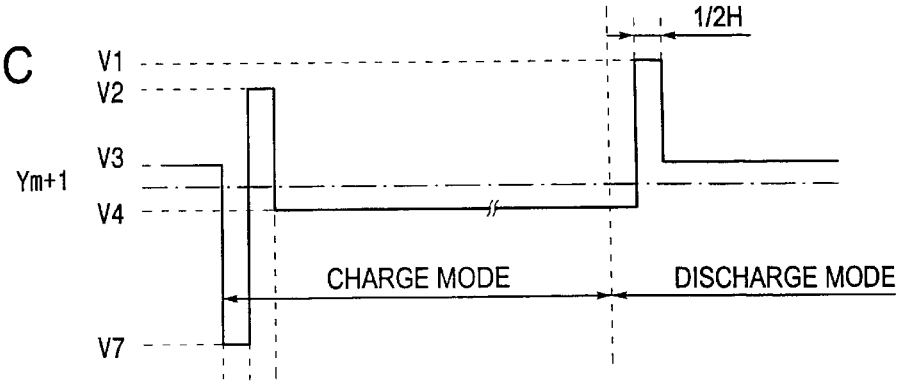
Figure 13D:
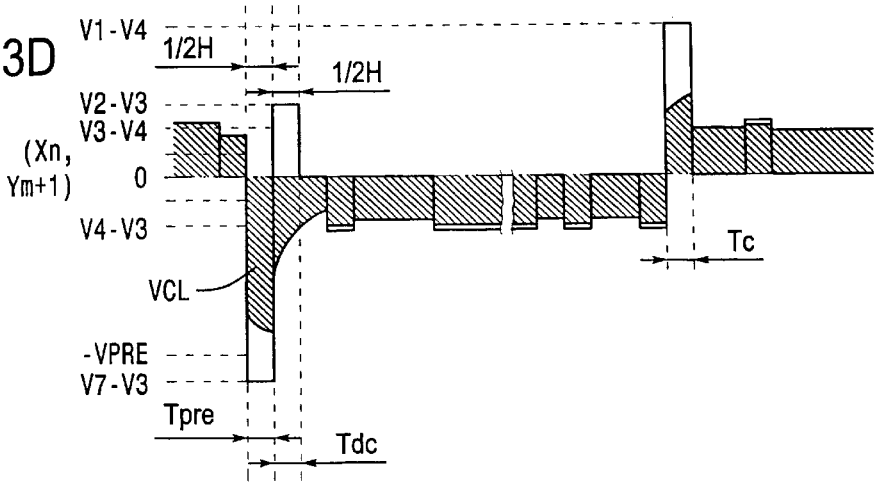

As shown in FIG. 12, the driving control circuit 120 may mainly cosist of a basic timing generating section 121, a driver control section 122, a data output section 123 and an A/D converting section 124.

The basic timing generating section 121 generates clock signals and timing signals to be supplied to the respective circuits on the basis of synchronization signals such as the vertical synchronization signal or the horizontal synchronization signal separated from a composite signal or the like, and supplies such signals to the driver control section 122, the data output section 123 and the A/D converting section 124.

The A/D converting section 124 converts an image signal which is an analog signal separated from the composite signal or the like into a digital data, and supplies the digital data to the data output section 123.

The data output section 123 converts digital data into gray scale data GD0 to GDn of n+1 bits, and serially supplies such data to the data signal driving circuit 110 as serial data at a prescribed timing on the basis of the clock signal from the basic timing generating section 121.

The driver control section 122 causes the basic timing generating section 121 to supply the scanning signal driving circuit 100 with the above-mentioned clock signal YCLK, latch strobe signal LS and the data D0 to D2, as well as a liquid crystal driving polarity signal M, while delivering the clock signal XCLK and the latch pulse signal LP to the data signal driving circuit 110.

Upon a signal PWR+ output from the off-sequence circuit 140, to be described later, reaching an H-level, the driver control section 122 shifts a signal XSET supplied to the scanning signal driving circuit 100 to an L-level, and converts the signal M determining the liquid crystal drive polarity in the charge mode or in the discharge mode to a signal synchronized with the scanning side clock signal YCLK.

The signal from the driver control section 122 is generated on the basis of the clock signal and the timing signal given by the basic timing generating section 121. The basic timing generating section 121 generates such clock signal and timing signal on the basis of synchronization signals such as the vertical synchronization signal or the horizontal synchronization signal. The scanning signal output from the scanning signal driving circuit 100 and the data signal output from the data signal driving circuit 110 are therefore also synchronized with the horizontal synchronization signal and the vertical synchronization signal.

[Driving Operation]

Operations performed when conducting a usual display in the liquid crystal display device by the scanning signal driving circuit 100, the data signal driving circuit 110 and the driving control circuit 120 will now be described with reference to FIGS. 13(*a*) to 13(*d*).

FIG. 13(*a*) is a timing chart illustrating a typical data signal available via a data line Xn ($X1 \leqq Xn \leqq Xi$). As shown in FIG. 13(*a*), data signal is supplied during the latter half of one horizontal scanning period H.

FIG. 13(*b*) is a timing chart illustrating a scanning signal available via a scanning line Ym ($Y1 \leqq Ym < Yj$); and FIG. 13(*c*) is a timing chart illustrating a scanning signal available via the next scanning line Ym+1. As shown in these figures, the scanning signals output from the scanning line driving circuit 100 are set so as to alternately provide a charge mode waveform and a discharge mode waveform for each horizontal scanning period H, and for each scanning line, the signals are set so as to alternately provide a charge mode waveform and a discharge mode waveform for each vertical scanning period TV.

FIG. 13(*d*) is a timing chart illustrating voltage applied on a pixel 16 located at a position corresponding to the point of intersection of the data line Xn and the scanning line Ym+1, i.e., the voltage applied between the opposite ends of the TFD element 20 and the liquid crystal layer 18. In FIG. 13(*d*), voltage VCL applied on the liquid crystal layer 18 is represented by hatched areas.

In this example, a voltage (V7-V3) is applied during an overcharging period Tpre in the discharge mode, leading to an ON-state of the TFD element 20, whereby the liquid crystal layer 18 is overcharged.

Then, during a discharge period Tdc, application of a voltage (V2-V3) inhibits the amount of discharge by the data signal, thus maintaining the charged state of the liquid crystal layer 18. Black is therefore displayed when the liquid crystal display device is set in the normally white mode, and white is displayed in the normally black mode.

Further, when a voltage (V1-V4) is applied during a charge period Tc in the charge mode after one vertical scanning period TV, the TFD element 20 is brought into an ON-state, the liquid crystal layer 18 is charged in response to the data signal. As a result, black is continuously displayed in the normally white mode, and white is continuously displayed in the normally black mode.

When a voltage (V2-V4) is applied during the discharge period Tdc in the discharge mode, in contrast, much of the charge charged into the liquid crystal layer 18 during the overcharge period Tpre is discharged, although not shown in the drawings. As a result, white is displayed in the normally white mode, and black in displayed in the normally black mode.

Further, even when a voltage (V1-V3) is applied during the charge period Tc in the charge mode after a vertical scanning period TV, charge to the liquid crystal layer 18 remains insufficient, though not shown. As a result, white is continuously displayed in the normally white mode, and black is continuously displayed in the normally black mode.

It is possible to control the display condition of the liquid crystal pixel by charging the liquid crystal layer 18 in response to the data signal through supply of a selection voltage V1 in the charge mode; then in the discharge mode, conducting overcharging, irrespective of the data signal, of the liquid crystal layer 18 through supply of a precharge voltage V7 having a reverse polarity to that of the selection voltage V1; followed by supplying a selection voltage V2 of a polarity reverse to that of the precharge voltage V7; and controlling the amount of discharge of the liquid crystal layer 18 by means of a data signal. Such charge mode and discharge mode are carried out also for the reverse polarity. As a result, the selection voltage determining the display condition would be V1 and V6 in the discharge mode, and V2 and V5 in the charge mode.

According to the described driving method which employs both the charge mode and the discharge mode, the charging is controlled by applying a voltage to the liquid crystal layer through the TFD element 20 in accordance with the data signal, under such a condition that the current in the TFD element 20 is bi-directional regardless of the polarity of the voltage applied to the liquid crystal layer. Therefore, any influence of polarity-dependency of the TFD element (asymmetry of current characteristic depending on polarity of voltage applied) can be eliminated.

Driving is performed alternately in charge and discharge modes, and both of these modes are alternately carried out both in positive and negative polarities. Therefore, although errors of the voltages applied to the liquid crystal layer may appear both in the charge and discharge modes due to variation of the voltage acting on the TFD element 20 upon substantial completion of the charging of the liquid crystal layer as a result of variation of the TFD element characteristic, such errors are canceled by each other in the sense of effective voltage, whereby problems such as production of non-uniform display can effectively be avoided.

[Off-Sequence Circuit]

A practical example of the off-sequence circuit 140 will now be described with reference to FIG. 14.

Figure 14:
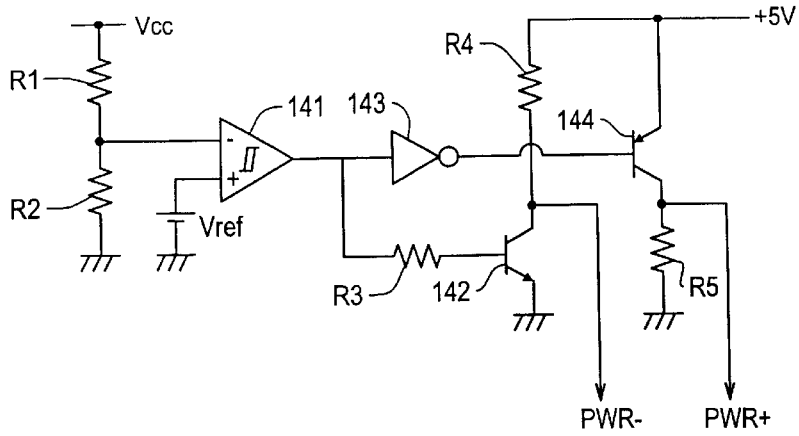
FIG. 14 is a circuit diagram illustrating the structure of an off-sequence circuit.

As shown in FIG. 14, a source voltage Vcc is divided by resistors R1 and R2 and supplied to a negative input terminal of a Schmidt type comparator 141, while a reference voltage Vref is supplied to a positive input terminal of the comparator 141. The voltage resulting from division of the source voltage Vcc by resistors R1 and R2 is higher than the reference voltage Vref during the turning-on of the power supply, so that the output of the comparator 141 is at the L-level. An output of the comparator 141 is supplied to a base (gate) of a transistor 142 via a resistor R3, and supplied also to a base (gate) of a transistor 144 via an inverter 143.

An emitter (source) of the transistor 142 is grounded, and on the other hand, a collector (drain) thereof is pulled up to +5 V via a resistor R4. Because the transistor 142 is usually in an OFF-state, the resulting pulled-up potential (H-level) is taken out as a signal PWR−. An emitter (drain) of the transistor 144 has a potential of +5 V, and the collector (source) is pulled down to the grounding level via a resistor R5. Because the transistor 144 is usually in an ON-state, the resulting pulled-down potential (L-level) is taken out as a signal PWR+.

As a result of turning-off of the power supply to the liquid crystal display device, therefore, the source voltage Vcc slowly goes down. When the source voltage Vcc divided by the resistors R1 and R2 decreases to under a voltage Vref, an output of the comparator 141 shifts from an L-level to an H-level. As a result, the transistor 142 is brought from an OFF-state to an ON-state, and on the other hand, the transistor 144 is brought from an ON-state to an OFF-state. When the source voltage Vcc is slowly reduced by turning off the power supply, therefore, the signal PWR− output from the off-sequence circuit 140 changes from an H-level to an L-level, and the signal PWR+ changes from an L-level to an H-level. The value of source voltage Vcc at which the output of the comparator 142 transits from the L-level to the H-level is referred to as the threshold voltage Vth (Vth =Vref where an offset voltage does not exist in the comparator, and Vth=Vref+Voff where an offset voltage is present). The off-sequence circuit 140 detects a power supply turning-off when the source voltage decreases to below the threshold value, thus causing changes in levels of the signal PWR+ and the signal PWR−, and outputs them. In this embodiment, a threshold voltage Vth of, for example, about 10 V is set.

[Constant Current Circuit]

The constant current circuit 150*a* will now be described. The constant current circuit 150*a* is a switching circuit which, upon a level transit of the signal PWR+ and the signal PWR− along with switching from power-on to power-off, substantially connects the supplying lines of selection voltage V1 and V6, determining the display condition of pixels in the scanning signal, to a grounding conductor. Details of a typical structure will be described with reference to FIG. 15.

Figure 15:
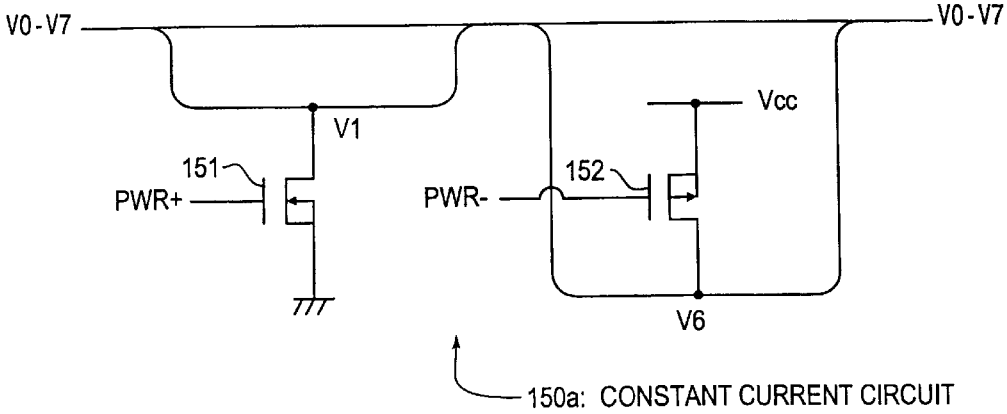
FIG. 15 is a circuit diagram illustrating the structure of a constant current circuit in the first embodiment.
Figure 16A:
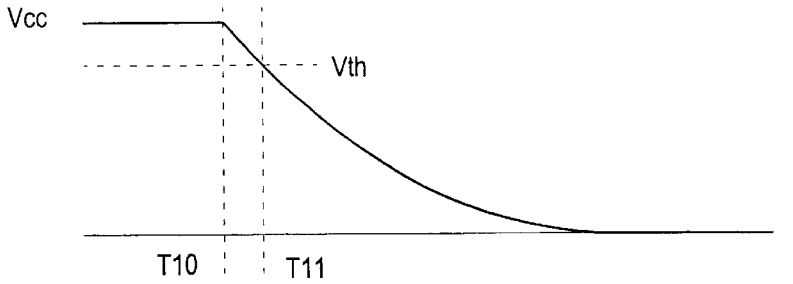
FIGS. 16(*a*) to 16(*f*) are timing charts illustrating operations during the turning-off of the power supply.
Figure 16B:
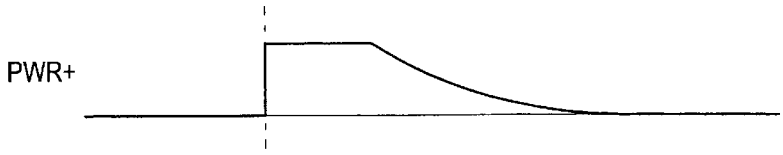
Figure 16C:
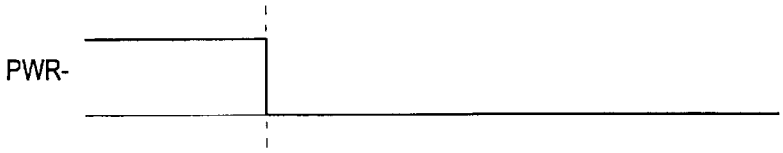
Figure 16D:
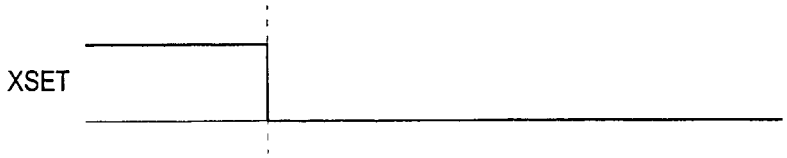
Figure 16E:
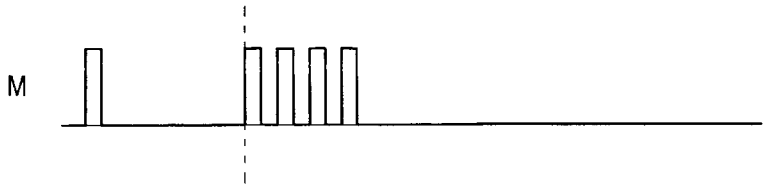
Figure 16F:
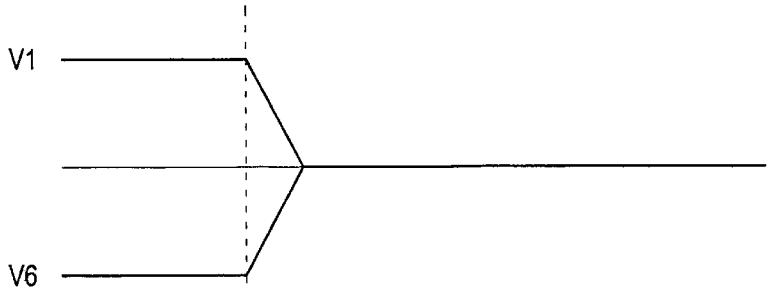

As shown in FIG. 15, the supplying line of voltage V1, from among the kinds of liquid crystal driving voltage V0 to V7 output from the DC-DC converter 130*a,* is connected to the drain of transistor 151. The signal PWR+ from the above-mentioned off-sequence circuit 140 is supplied to a gate of transistor 151, while the source thereof is grounded. That is, since the signal PWR+ is usually on an L-level, the transistor 151 is in an OFF-state. However, when the signal PWR+ reaches an H-level as a result of the power supply turning off, the transistor 151 is turned on.

The supplying line of voltage V6, out of the voltages V0 to V7 output from the DC-DC converter 130*a,* is connected to the source of the transistor 152. The signal PWR− from the off-sequence circuit 140 is supplied to the gate of the transistor 152, while the drain thereof is connected to source voltage Vcc. That is, since the signal PWR− is usually on an H-level, the transistor 152 is in an off-state. However, in this structure, the transistor 152 is also turned on when the signal PWR− reaches an L-level as a result of the power supply turning off.

[Turning-Off Operation of The Power Supply]

The turning-off operation in the configuration of the off-sequence circuit 140 and the constant current circuit 150*a* will now be described with reference to FIGS. 16(*a*)–(*f*).

First, as shown in FIG. 16(*a*), when the power supply is turned off at a timing T10, source voltage Vcc gradually decreases to the grounding level. If the source voltage Vcc decreases below the threshold voltage Vth at a timing T11, the signal PWR+ transits to an H-level (see FIG. 16(*b*)). On the other hand, the signal PWR− transits to an L-level (see FIG. 16(*c*)).

When the signal PWR+ transits to the H-level, the signal XSET transits to an L-level under the action of the driver control section 122 (see FIG. 12) in the driving control circuit 120 (see FIG. 16(*d*)), and on the other hand, the signal M having so far regulated the liquid crystal driving polarity in the charge mode or in the discharge mode is synchronized with the scanning side clock signal YCLK (see FIG. 16(*e*)). This scanning side clock signal YCLK is a high-frequency clock signal transferring voltage selection data D0 to D2 for the scanning line to the scanning line driving circuit 100 within a period of ½ H. Therefore, the signal M is also switched over to a high-frequency clock signal in response to detection of the power supply turning off. A scanning side clock signal YCLK may be used instead of the signal M.

As a result of a transition of the signal XSET to the L-level, and synchronization of the signal M with the scanning side clock signal YCLK, a signal for forcedly and alternately selecting voltage V1 and voltage V6 is output from the decoder 105 in the scanning signal driving circuit 100, irrespective of parallel data from the latch 104.

As a result, all of the scanning lines Y1 to Yj are alternately selected and connected to the supplying line of voltage V1 and to the supplying line of voltage V6 in synchronization with the scanning side clock signal YCLK or with the signal M by means of an LCD driver 107.

On the other hand, when the signal PWR− transits to the L-level, the above-mentioned constant current circuit 150*a* connects the supplying line of voltage V1 through the transistor 151 to the grounding conductor, and connects the supplying line of voltage V6 to the supplying line of source voltage Vcc through the transistor 152. The supplying line of voltage V6 is connected to the supplying line of source voltage Vcc. Since the source voltage Vcc soon reaches on the grounding level as shown in FIG. 16(*a*), this configuration is substantially equivalent to that in which the supplying line of voltage V6 is connected to the grounding conductor.

Therefore, the charge accumulated in all of the liquid crystal layers 18 is forcedly discharged by the transistor 151 in the constant current circuit 150*a* via the supplying line of voltage V1, then forcedly drained off by the transistor 152 via the supplying line of voltage V6, and draining and discharging of the charge are alternately repeated in response to short-period switching of the signal YCLK or the signal M. More specifically, the transistor 151 drains current from all of the liquid crystal layers 18, while the transistor 152 discharges current to all of the liquid crystal layers 18. Particularly, because the supplying lines of selection voltage V1 and V6 of the scanning signal are used for removing the charge from the liquid crystal layer 18, the potential of the two supplying lines is near the selection voltage in the initial stage of detection of the power supply turning off. It is therefore possible to turn on the TFD element 20, so that accumulated charge can be removed alternately onto the V1 and V6 sides from the liquid crystal layer through the TFD element 20. Upon the power supply turning-off operation, a voltage is applied onto the liquid crystal layer 18 alternately in the positive and negative polarities. The charge can therefore be discharged irrespective of the voltage level, positive or negative, of the voltage accumulated in the pixels at the timing of the power supply turning-off.

As a result, all of the liquid crystal layers 18 are in a state as if they are connected to a kind of fixed potential, thus permitting quick removal of the charge stored therein, at a constant rate (see FIG. 16(*f*)). In this embodiment, connection between the data lines and the voltage supplying lines V1 or V6 is switched over in accordance with the frequency of the signal YCLK or the signal M. Synchronization may however be made with any other signal so far as it is a clock signal having a frequency higher than ½ H.

According to the liquid crystal display device of this embodiment, therefore, it is not necessary to depend upon factors such as the resistance of the pixel electrode, the size thereof, the material of the liquid crystal, or the distance between the substrate, thus permitting easy setting of a time until the charge stored in the liquid crystal layer becomes null.

<Liquid Crystal Display Device of Second Embodiment>

The liquid crystal display device of a second embodiment of the present invention will now be described.

The constant current circuit 150*a* (see FIG. 4) in the aforementioned first embodiment has been used to indirectly execute the connecting operation of the supplying lines of voltage V1 and voltage V6 to the grounding conductor via level transition of the signal PWR+ and the signal PWR−. In the second embodiment, in contrast, the constant current circuit 150*b* is used to carry out the same directly through voltage drop of source voltage Vcc.

Figure 17:
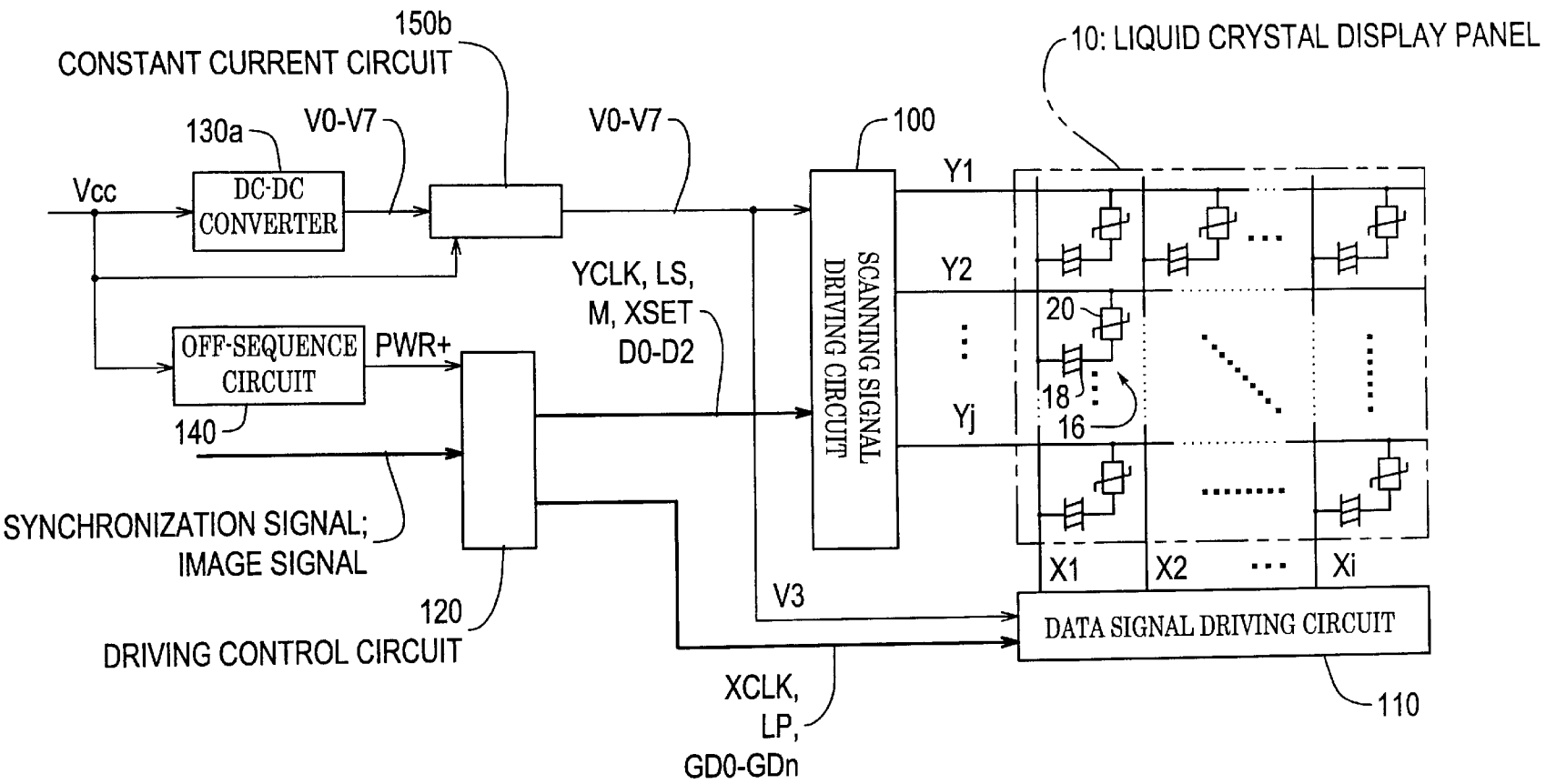
FIG. 17 is a block diagram illustrating a critical structure of the liquid crystal display device of the second embodiment of the invention.

As a result, the liquid crystal display device of the second embodiment as shown in FIG. 17 is different from that of the first embodiment in that the signal PWR+ and the signal PWR− are not supplied to the constant current circuit 150*b*.

Figure 18:
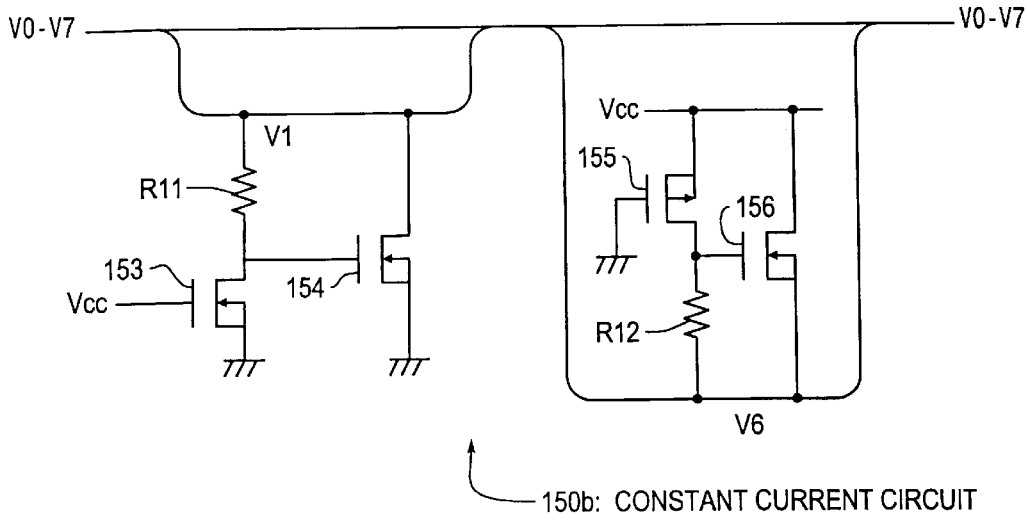
FIG. 18 is a circuit diagram illustrating a configuration of the constant current circuit used in the second embodiment.

Details of the constant current circuit 150*b* will be described with reference to FIG. 18. As shown in FIG. 18, source voltage Vcc is directly supplied to the gate of a transistor 153 having the source grounded. The drain is pulled up to voltage V1 from among voltages V0 to V7 output from the DC-DC converter 130*a* via a resistance R11. The thus pulled-up drain of the transistor 153 is connected to the gate of a transistor 154, the source thereof being grounded, and the drain thereof is connected to the supplying line of voltage V1.

That is, when source voltage Vcc is a usual voltage in power supply turning-on, the transistor 153 is in OFF-state, whereas, when source voltage Vcc decreases to the voltage Vth, the transistor 153 -reaches an ON-state, and the transistor 154 is pulled up into an ON-state. In this structure, therefore, the supplying line of voltage V1 is connected to the grounding conductor through the transistor 154.

On the other hand, the gate of a transistor 155 is grounded, and the drain thereof is pulled down to voltage V6, from among the voltages V0 to V7, via resistance R12. The source thereof is connected to the supplying line of source voltage Vcc. The source of the thus pulled-down transistor 155 is connected to the gate of a transistor 156, the source thereof being connected to the supplying line of voltage V6, and the drain thereof is connected to the supplying line of source voltage Vcc.

More specifically, when source voltage Vcc is a usual voltage in power supply turning-on, the transistor 155 is in an OFF-state, whereas, when source voltage Vcc decreases to below voltage Vth, the transistor 155 is brought into an ON-state, and the transistor 156 is also brought from an OFF-state into an ON-state. In this configuration, therefore, the supplying line of voltage V6 is connected to the supplying line of source voltage Vcc. Source voltage Vcc soon reaches the grounding level as shown in FIG. 16(*a*). This configuration is therefore substantially equivalent to that in which the supplying line of voltage V6 is connected to the grounding conductor through the transistor 156.

The other components are the same as those in the first embodiment. More specifically, when source voltage Vcc decreases, all of the scanning lines Y1 to Yj are alternately switched over at a high frequency and connected to the supplying lines of voltage V1 and voltage V6. Because the transistors 154 and 156 in the constant current circuit 150*b* bring the supplying lines of voltage V1 and voltage V6 to grounding level, the charge stored in all of the liquid crystal layers 18 can be discharged quickly at a constant rate as in the first embodiment.

<Liquid Crystal Display Device of Third Embodiment>

The liquid crystal display device of a third embodiment of the invention will now be described. The portions not described have the same configuration as in the first embodiment described before.

In the first and the second embodiments described above, the supplying lines of voltage V1 and voltage V6 are connected to the grounding conductor upon detection of a decrease in the source voltage Vcc by the constant current circuit 150*a* or 150*b*. In the third embodiment, the DC-DC converter 130*b* plays the role of connecting the supplying lines of voltage V1 and voltage V6 to the grounding conductor.

Figure 19:
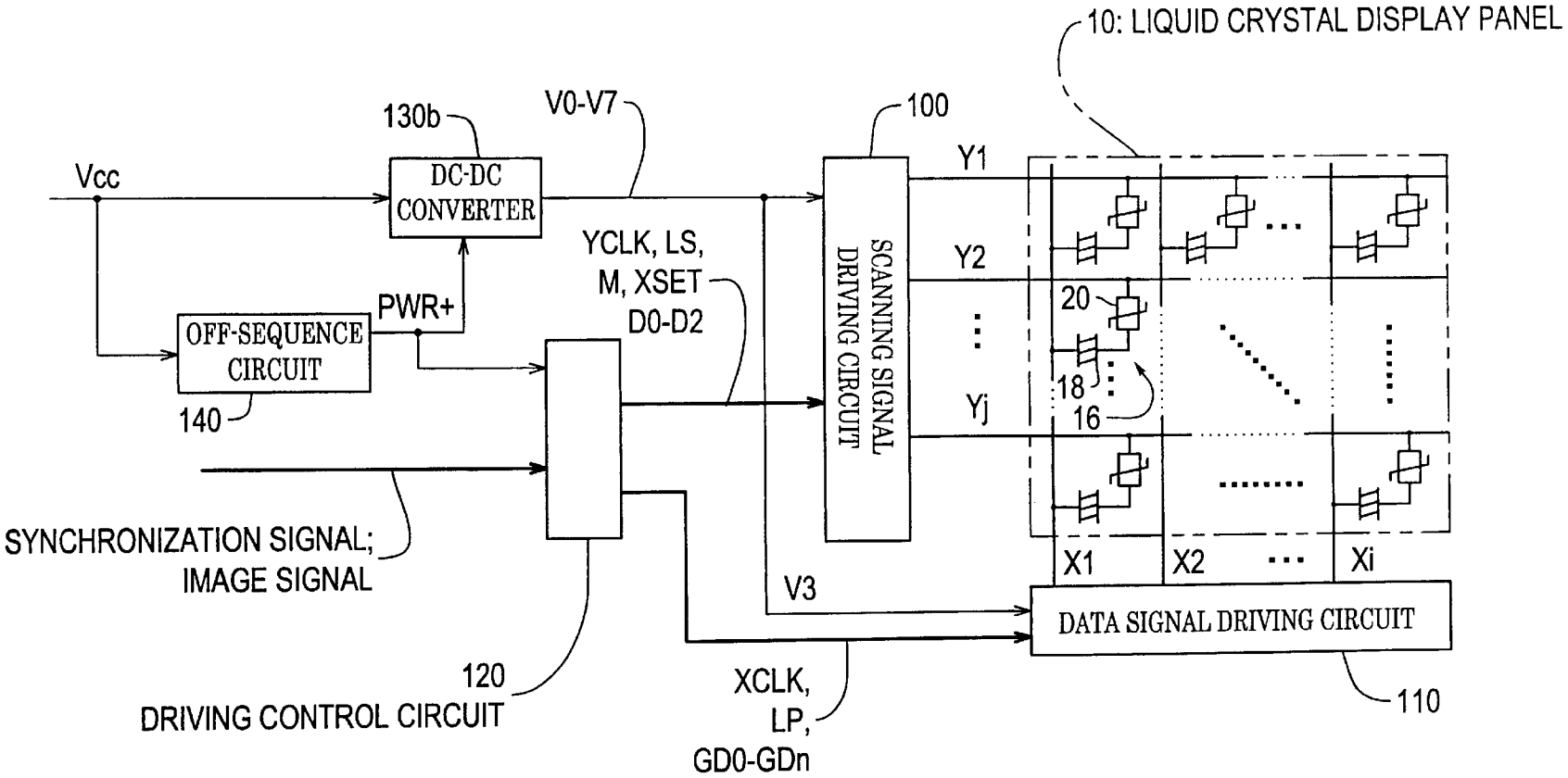
FIG. 19 is a block diagram illustrating a critical structure of the liquid crystal display device of the third embodiment of the present invention.

To this end, in the liquid crystal display device of the third embodiment, as shown in FIG. 19, a constant current circuit 150*a* or 150*b* is non-existent, but in this case, the signal PWR+ and the signal PWR− are supplied to the DC-DC converter 130*b*. In this arrangement, the final-stage transistor outputting voltage V1 and voltage V6 in the DC-DC converter has a construction substantially the same as those of transistors 151 and 152 shown in FIG. 15.

That is, in the DC-DC converter 130*b*, the final-stage transistor is configured so that the drained current value from the supplying line of voltage V1 and the discharged current value to the supplying line of voltage V6 become larger.

In the liquid crystal display device of the third embodiment as well, therefore, as in the first and the second embodiments, it is possible to quickly remove the charge stored in all of the liquid crystal layers 18 at a constant rate.

<Liquid Crystal Display Device of Fourth Embodiment>

The liquid crystal display device of a fourth embodiment of the invention will now be described. The portions not described have the same configuration as those in the aforementioned first embodiment.

The first to third embodiments described above have the structure in which the pixels at positions corresponding to the points of intersection between the scanning lines Y1 to Yj and the data lines X1 to Xi of the liquid crystal display panel 10 are constituted by electric serial connections of two-terminal type non-linear elements 20 and liquid crystal layers 18. In this embodiment, stripe-arranged scanning lines (scanning electrodes) Y1 to Yj and stripe-arranged data lines (data electrodes) Z1 to Xi are caused to cross each other. Pixels 16 are formed with liquid crystal layers at the crossing portions, and a switching element is not arranged on each pixel 16. That is, the liquid crystal display panel 10 has a configuration in which a first substrate having scanning lines Y1 to Yj formed on the inner surface thereof and a second substrate having data lines X1 to Xi formed on the inner surface thereof are placed opposite to each other, and an STN (super twisted nematic) type liquid crystal 18 of which liquid crystal molecules have a twisting alignment larger than 180° is held between the pair of substrates. Although not shown, a retardation film is arranged on the other side of at least one of the pair of substrates, a pair of polarization plates are arranged with the pair of substrates and the retardation film in between. More specifically, in this configuration as shown in FIGS. 4, 17 and 19, the voltage difference between the scanning lines and the data lines is applied directly onto the liquid crystal layers 18 of the pixels 16, without the intermediary of the TFD element 20.

Figure 20:
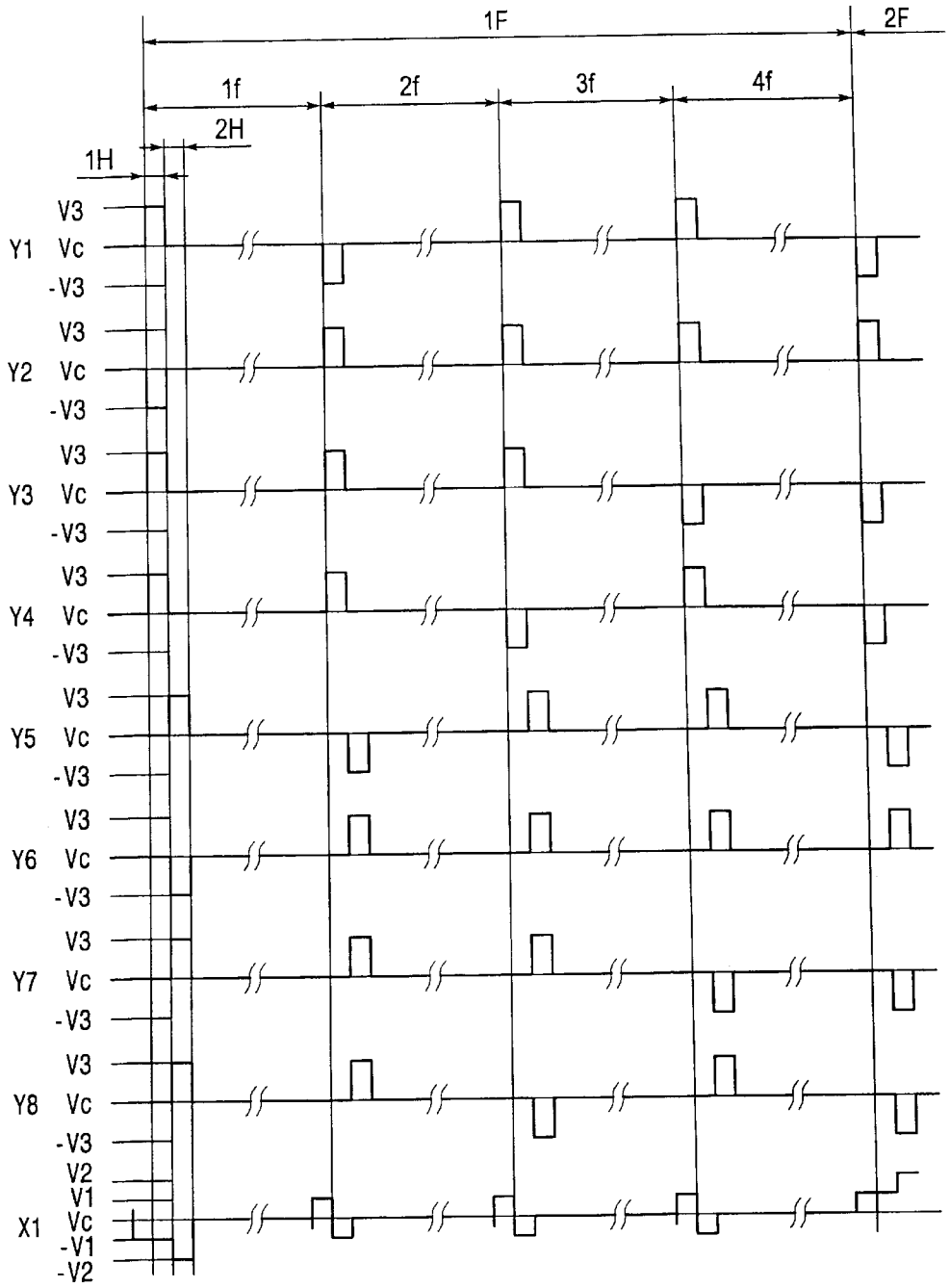
FIG. 20 is a view illustrating a driving waveform showing operations of the liquid crystal display device of the fourth embodiment of the invention.

FIG. 20 illustrates the driving waveform of the liquid crystal display device of this embodiment. The driving method shown in FIG. 20 may consist of the steps of simultaneously selecting four scanning lines and sequentially selecting lines in units of four lines (Multi-Line Selection). Therefore, a selection voltage V2 or −V2 of a signal polarity determined on the basis of an orthogonal matrix is applied on simultaneously selected scanning lines. This orthogonal matrix rules signal polarity of selection voltage applied on scanning lines simultaneously selected during, for example, a period of a frame. When four lines are selected at a time and four runs of selection are conducted in a frame, for example, the resultant matrix would have four rows and four columns.

In FIG. 20, Y1 to Y8 represent scanning signal waveforms applied by the scanning signal driving circuit 100 onto the scanning lines Y1 to Y8, and X1 represents a data signal waveform applied from the data signal driving circuit 110 onto the data line X1. For example, a line selection voltage out of four simultaneously selected lines has a signal polarity reverse to that of selection voltage of the other three lines. Each line is selected four times during a frame period, and among these four times, a selection voltage having a signal polarity reverse to the others is applied once. In FIG. 20, each line is selected once (1H period) for each of the fields f1 to f4. The pulse waveform may be determined such as to continue selection of each scanning line for a certain time length within each frame period (1F) while the rest of the frame period constitutes a non-selection period, instead of selecting the scanning line four times in a discrete manner along the time axis in the frame period.

For the data lines X1 to Xi, on the other hand, selection is made from voltages V2, V1, −V1 and −V2 in accordance with the result of a matrix calculation of the aforementioned orthogonal matrix and displayed data (on or off) of the pixels at points of intersection of the four scanning lines and the data lines. During the first 1H of the data line X1 shown in FIG. 20, therefore, voltage −V1 is selected in accordance with the result of calculation of the on/off data matrix of four pixels at points of intersection of the data line X1 and the scanning lines Y1 to Y4 and the aforementioned orthogonal matrix.

In the simple matrix type liquid crystal display device as described above, seven levels of driving voltages Vc, V1 to V3, and −V1 to −V3 are formed by the DC-DC converter 130*a* or 130*b* as in the preceding embodiments. The central voltage Vc is the grounding voltage.

In the liquid crystal display device of this embodiment as well, the supplying lines of voltages V3 and −V3 can be connected to the grounding conductor, through detection of a turning-off or a drop in the source voltage Vcc, by adopting a structure in which the transistors 151 and 152 shown in FIG. 15 or the transistors 154 and 156 shown in FIG. 18 are connected to the voltage supplying lines V3 and −V3 of the scanning signal, or a structure of the DC-DC converter 130*b* same as that shown in FIG. 19. In the scanning signal driving circuit 100, all of the scanning lines Y1 to Yj can be alternately connected, through switching at a high frequency, to the supplying lines of voltages V3 and −V3, as in the above-mentioned embodiments, by alternately connecting all the scanning lines Y1 to Yj to the supplying lines of voltages V3 and −V3 in synchronization with clock signals of a frequency far higher than 1H. Since the supplying lines of voltages V3 and −V3 gradually reach the grounding level (Vc), as in the above-mentioned embodiments, it is possible to rapidly clear the charge accumulated in all of the liquid crystal layers 18 at a constant rate. Particularly, because the scanning signal has a greater amplitude than the data signal, it becomes easier to discharge the charge by releasing the charge of the liquid crystal layers through alternately applying positive and negative selection voltage of the scanning signal onto the liquid crystal layers while converging this voltage into the grounding potential, since this results in application of a voltage larger than the voltage accumulated in the liquid crystal layers.

In this embodiment, the high frequency clock employed in the high-rate transfer of the data signals GD0 to GDn to the data signal driving circuit 110 is preferably used also for the purpose of switching control for switching the connection between the scanning lines and the voltage lines of V3 and −V3 in the scanning signal driving circuit 100.

The liquid crystal layers 18 may be connected to the fixed potential, not through the scanning lines, but through the data lines. More specifically, the supplying lines can be connected to the grounding conductor through detection of a turning-off or a drop in the source voltage Vcc, by adopting a structure in which the transistors 151 and 152 shown in FIG. 15 or the transistors 154 and 156 shown in FIG. 18 are connected to the supplying lines of driving voltages V1 and −V1 or V2 and −V2 for supplying voltage to the data lines X1 to Xi, or a configuration of the DC-DC converter 130*b* as shown in FIG. 19. Further, it is possible to connect all of the signal lines to the grounding conductor through the supplying lines of voltages V1 and −V1 or the supplying lines of voltages V2 and −V2 by alternately switching and connecting all the data lines X1 to Xi between the supplying lines of V1 and −V1, or between the supplying lines of V2 and −V2, in synchronization with the clock signal of a frequency far higher than 1H, as in the preceding embodiments. Since the supplying lines of voltage V1 and −V1 or voltage V2 and −V2 gradually approach the grounding level (Vc) by the effect of transistors connected to the voltage supplying lines, as in the preceding embodiments, it is possible to rapidly clear the charge accumulated in all of the liquid crystal layers 18 at a constant rate.

The charge of the liquid crystal layers may further rapidly be removed by connecting the scanning lines to the grounding conductor, and simultaneously, connecting the data lines to the grounding conductor.

<Modifications>

In the first to fourth embodiments described heretofore the turning-off of the power supply is indirectly detected by sensing a decrease on the source voltage Vcc. This, however, may obviously be modified such that the signals PWR+ and PWR− are generated upon direct detection of the turning-off of the power supply, so as to enable discharge of the charge stored in the liquid crystal layers.

In first to fourth embodiments, upon detection of the turning-off of the power supply by means of a decrease in the source voltage Vcc, all of the scanning lines Y1 to Yj are alternately connected to the two supplying lines of voltage V1 and voltage V6, and these lines are connected to the grounding conductor via the transistors 151 and 152. All of the data lines X1 to Xi may however be connected to the grounding conductor at a time in response to the signal PWR+ or the signal PWR−. That is, the signal PWR+ or the signal PWR− may be supplied to the data signal driving circuit 110, and the data signal driving circuit 110 may connect all of the data lines X1 to Xi to the grounding conductor upon a level transition of the signal PWR+ or the signal PWR− as shown in FIG. 11. As is typically represented by the data line Xi in FIG. 11, it suffices to connect a transistor 160 between the grounding conductor and the data line Xi, enter the signal PWR+ into the gate of the transistor 160, and upon the power supply turning off, turning on the transistor 160 to connect the data line Xi to the grounding conductor. In this case, the transistor 160 is connected between each of the data lines X1 to Xi and the grounding conductor. The scanning lines may be connected to the grounding potential in the same manner as the aforementioned embodiments, and the data lines may simultaneously be connected to the grounding potential.

Further, in the structures of first to third embodiments, upon detection of the turning-off of the power supply from a decrease in the source voltage Vcc, all of the scanning lines Y1 to Yj are alternately connected to the supplying lines of selection voltage V1 and selection voltage V6 of the scanning signal determining the display condition of the pixels in the charge mode. However, the arrangement may be such that the connection is made alternately to the supplying lines of selection voltage V2 and selection voltage V5 of the scanning signal that determine the display condition of pixels in the discharge mode.

<Electronic Apparatus :1>

Some of examples of electronic apparatuses using the liquid crystal display device of any of the aforementioned first to fourth embodiments will now be described.

Figure 21:
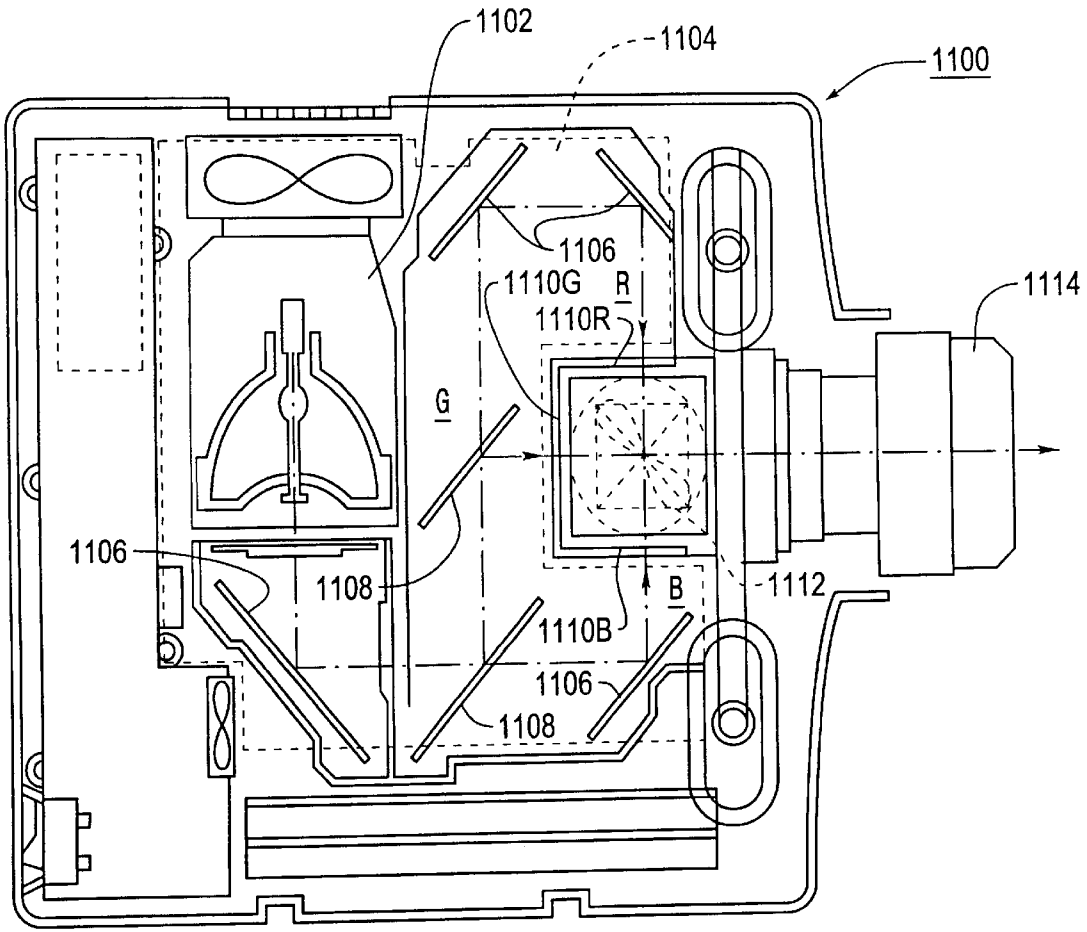
FIG. 21 is a sectional view illustrating the structure of a liquid crystal projector, an example of the electronic apparatus incorporating the liquid crystal display panel.

First, a video projector using this liquid crystal display device as a light valve will be described. FIG. 21 is a plan view illustrating a typical configuration of the video projector.

As shown in FIG. 21, a lamp unit 1102 consisting of a white light source such as a halogen lamp is provided in a video projector 1100. The projected light irradiated from this lamp unit 1102 is separated into three primary colors of R, G and B by a plurality of mirrors 1106 . . . and two dichroic mirrors 1108 arranged within a light guide 1104, and enters into liquid crystal display panels 1110R, 1110B and 1110G serving as a light valve corresponding to the individual primary colors.

The liquid crystal panels 1110B, 1111B and 1110G each may consist of the aforementioned liquid crystal panel 10, and driven by R, G and B primary color signals supplied by a circuit not shown. The light beams modulated by these liquid crystal panels enter the dichroic prism 1112 from three directions. In this dichroic prism 1112, the light beams R and B are refracted by 90°, while the light beam G advances straight ahead. As a result of the synthesis of images of the individual colors, a color image is projected onto a screen or the like via a projecting lens 1114.

Since light beams corresponding to the individual primary colors R, G and B enter into the liquid crystal panels 1110R, 1110B and 1110G, respectively, by means of the dichroic mirror 1108, it is not necessary to provide a color filter on the counter substrate 32.

<Electronic Apparatus :2>

Figure 22:
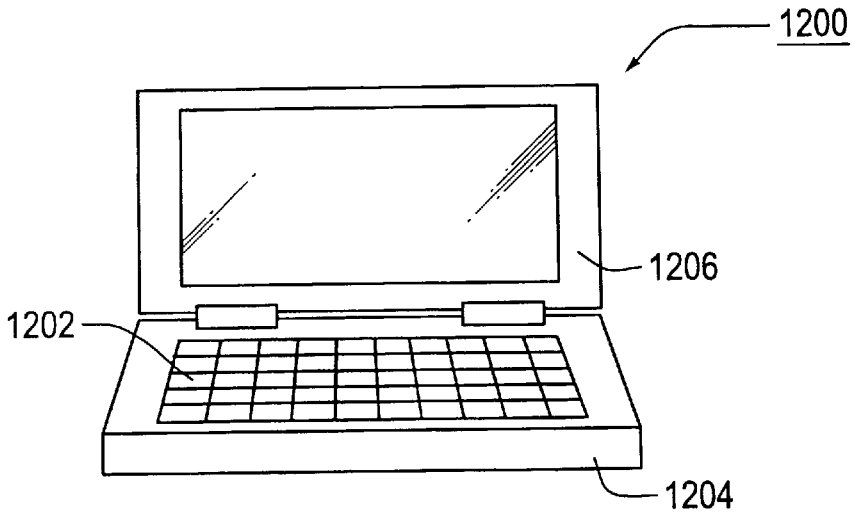
FIG. 22 is a front view showing the structure of a personal computer, an example of the electronic apparatus incorporating the liquid crystal display panel.

Another example of application of the liquid crystal display device, a personal computer, will be described. FIG. 22 is a front view illustrating the configuration of this personal computer. In FIG. 22, a personal computer 1200 may consist of a computer body 1204 having a keyboard 1202 and a liquid crystal display 1206. The liquid crystal display 1206 may consist of the above-mentioned liquid crystal panel 10 added with a color filter and a backlight.

<Electronic Apparatus :3>

Figure 23:
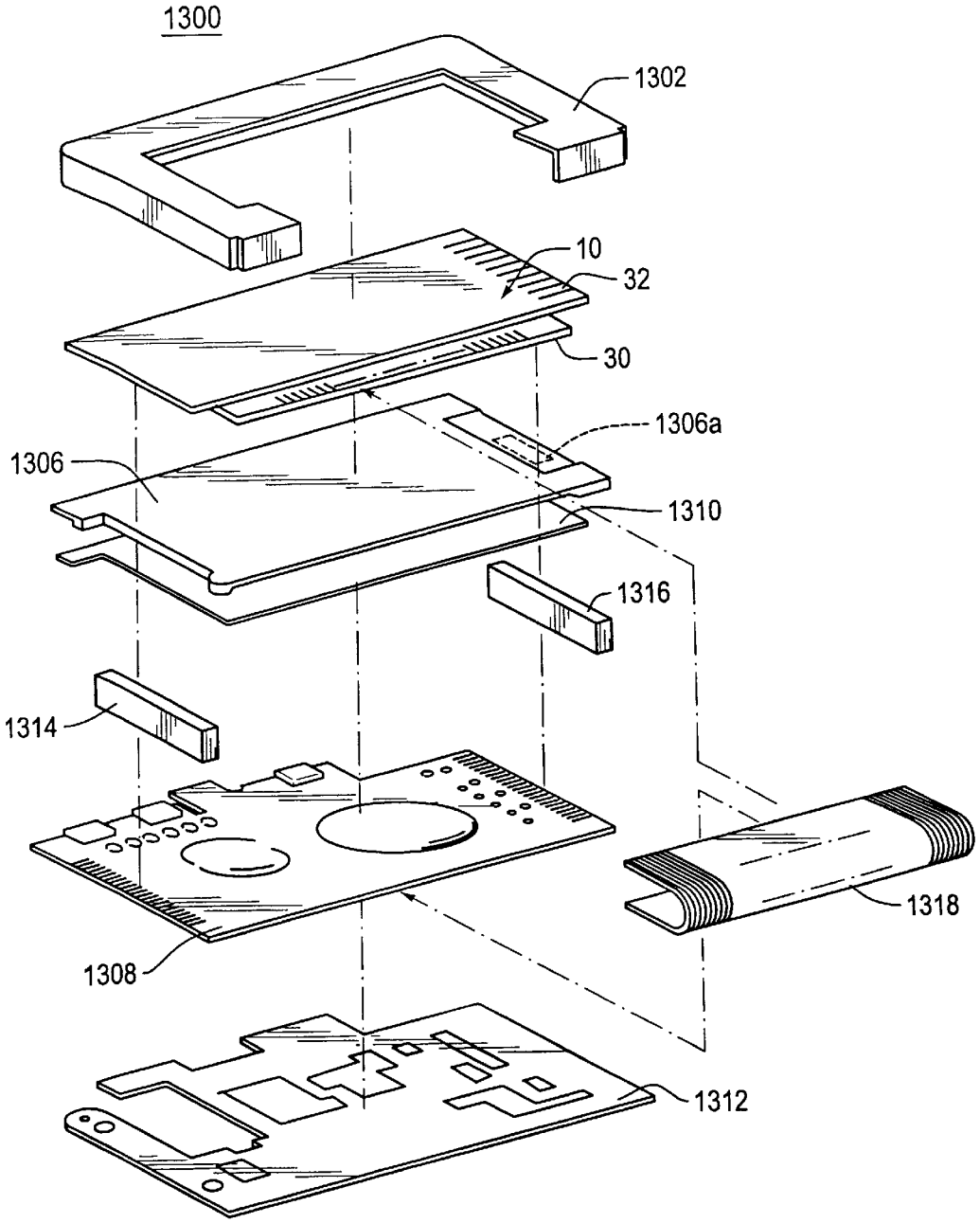
FIG. 23 is an exploded perspective view showing the structure of a pager, an example of the electronic apparatus incorporating the liquid crystal display panel.

An example of application of the liquid crystal display panel, a pager, will now be described. FIG. 23 is an exploded perspective view illustrating the structure of the pager. As shown in FIG. 23, the pager 1300 may consist of a liquid crystal display panel 10, a light guide 1306 containing a backlight 1306*a*, a circuit substrate 1308, and first and second shielding plates 1310 and 1312 housed in a metal frame 1302. Communication with the liquid crystal panel 10 and the circuit substrate 1308 is accomplished by two elastic conductors 1314 and 1316 for the counter substrate 32, and by a film tape 1318 for the element array substrate 30.

Apart from the electronic apparatuses described with reference to FIGS. 21 to 23, examples of electronic apparatuses include a liquid crystal television set, a view finder type video cassette recorder, a monitor direct-viewing type video cassette recorder, a car navigation device, an electronic pocketbook, a calculator, a wordprocessor, a workstation, a portable telephone, a TV telephone, a POS terminal, and a device having a touch panel. It is needless to mention that the present invention is applicable to these various devices.

According to the present invention, as described above, because the liquid crystal layer is connected to the fixed potential upon detection of the turning-off of the power supply to liquid crystal display device, the charge stored in the liquid crystal layer is quickly cleared without depending upon the individual component devices, thus permitting prevention of deterioration of the liquid crystal.

What is claimed is:

1. A method for controlling a liquid crystal layer in a liquid crystal display device, the method comprising:

detecting a turning-off of a power supply on which the liquid crystal display device operates; and connecting a first connector to a ground level upon detection of the turning-off of the power supply, and connecting a second connector to a source voltage upon detection of the turning-off of the power supply.

2. The method for controlling a liquid crystal display device according to claim 1, further comprising a predetermined voltage supplying line comprising a first voltage supplying line that supplies a positive voltage relative to said ground level and a second voltage supplying line that supplies a negative voltage relative to said ground level, the method further comprising, upon the detection of the turning-off of the power supply, alternately connecting a signal line to said first voltage supplying line and said second voltage supplying line.

3. The method for controlling a liquid crystal display device according to claim 2, said signal line being alternately connected to said first voltage supplying line and said second voltage supplying line in response to a clock signal having a period shorter than a half the horizontal scanning period.

4. A driving device for driving a liquid crystal display device that displays a desired image by controlling an amount of charge stored in a liquid crystal layer, the driving device comprising:

a first transistor and second transistor;

a detector that detects a turning-off of a power supply on which a liquid crystal display device operates; and a connection device that, upon detection of the turning-off of the power supply by said detector, connects said first transistor to a ground level, and connects the second transistor to a source voltage.

5. The driving device for driving a liquid crystal display device according to claim 4, said detector detecting the turning-off of the power supply when the source voltage decreases to at least a predetermined threshold value.

6. The driving device for driving a liquid crystal display device according to claim 4, said connection device comprising a switch that connects, upon the detection of the turning-off of the power supply by said detector, said liquid crystal layer to a grounding conductor.

7. A driving device for driving a liquid crystal display device that displays a desired image by controlling an amount of charge stored in a liquid crystal layer, the driving device comprising:

a detector that detects a turning-off of a power supply on which a liquid crystal display device operates; and a connection device that, upon detection of the turning-off of the power supply by said detector, connects a first connector to a ground level, and connects a second connector to a source voltage.

8. The driving device for driving a liquid crystal display device according to claim 7, further comprising a predetermined line comprising a first supplying line that supplies a positive voltage relative to said ground level and a second supplying line that supplies a negative voltage relative to said ground level; and upon the detection of said turning-off of the power supply, said connection device connecting a signal line alternately to said first supplying line and said second supply line.

9. The driving device for driving a liquid crystal display device according to claim 8, said signal line being alternately connected to said first voltage supplying line and said second voltage supplying line in response to a clock signal having a period shorter than a half of a horizontal scanning period.

10. A liquid crystal display device that displays a desired image by controlling amounts of charge stored in liquid crystal layers, the liquid crystal display device comprising:

a detector that detects a turning-off of a power supply on which a liquid crystal display device operates;

a controller that provides an instruction to connect predetermined lines upon detection of the turning-off of the power supply by said detector;

a first connector that connects at least one of the predetermined lines, in response to said instruction, to a ground level; and a second connector that, upon the detection of the turning-off of the power supply, connects another one of the predetermined lines to a source voltage to discharge current to the liquid crystal layer.

11. An electronic apparatus comprising a liquid crystal display device according to claim 10.

12. A liquid crystal display device comprising:

a liquid crystal display panel having first substrate provided with a data line, a second substrate provided with a scanning line, and a plurality of pixels each having a series of connection of a non-linear element and a liquid crystal layer connected between said data line and said scanning line;

a detecting circuit that detects a turning-off of a power supply on which the liquid crystal display device operates; and a switch circuit that connects, upon detection of the turning-off of the power supply by said detecting circuit, a first supplying line of a selection voltage to be applied onto said scanning line to a ground level, and connects a second supplying line of a selection voltage to a source voltage.

13. The liquid crystal display device according to claim 12, said switching circuit connecting, upon the detection of the turning-off of the power supply, said scanning line to the first supplying line for supplying a voltage for turning on said non-linear element, and connects said supplying line to the ground level.

14. The liquid crystal display device according to claim 13, said supplying line comprising a first supply line that supplies a positive selection voltage relative to the ground level, and a second supplying line that supplies a negative selection voltage relative to the ground level, and said scanning line being alternately connected to said first supplying line and said second supplying line.

15. The liquid crystal display device according to claim 12, said non-linear element comprising a two-terminal type non-linear element.

16. The liquid crystal display device according to claim 13, said two-terminal type non-linear element comprising a thin film diode element comprising a first metal, an insulator, and a second metal arranged in this order.

17. A liquid crystal display device comprising:

a liquid crystal display panel comprising a liquid crystal layer held between a first substrate having data lines and a second substrate having scanning lines;

a detecting circuit that detects a turning-off of a power supply on which a liquid crystal display device operates; and a switching circuit that connects, upon detection of the turning-off of the power supply by said detecting circuit, a first supplying line of voltage to be applied onto one of said scanning lines and said data lines to a ground level, and connects a second supplying line of a selection voltage to a source voltage.

18. The liquid crystal display device according to claim 17, one of said scanning lines and said data lines being alternately connected, upon detecting of the turning-off of the power supply, to a first supplying line that supplies a positive voltage relative to said ground level and a second supplying line that supplies a negative voltage relative to said ground level; and said switching circuit connecting said first supplying line and said second supplying line to said ground level.

19. A method for controlling a liquid crystal layer in a liquid crystal display device connected to a thin film diode, the method comprising:

detecting a turning-off of a power supply on which the liquid crystal display device operates; and connecting a first transistor to a ground level upon detection of the turning-off of the power supply, and connecting a second transistor to a source voltage upon detection of the turning-off of the power supply.

* * * * *